US007665823B2

(12) United States Patent
Yakura et al.

(10) Patent No.: US 7,665,823 B2
(45) Date of Patent: Feb. 23, 2010

(54) LIQUID DISCHARGING APPARATUS AND CONTROL METHOD THEREFOR

(75) Inventors: Yuji Yakura, Kanagawa (JP); Kenji Suzuki, Kanagawa (JP); Takanori Takahashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 384 days.

(21) Appl. No.: 10/561,696

(22) PCT Filed: Jul. 2, 2004

(86) PCT No.: PCT/JP2004/009776

§ 371 (c)(1),
(2), (4) Date: Mar. 9, 2007

(87) PCT Pub. No.: WO2005/002859

PCT Pub. Date: Jan. 13, 2005

(65) Prior Publication Data

US 2008/0049058 A1 Feb. 28, 2008

(30) Foreign Application Priority Data

Jul. 4, 2003 (JP) ..... 2003-191815
Jul. 4, 2003 (JP) ..... 2003-191816
Jul. 4, 2003 (JP) ..... 2003-191817
Jul. 4, 2003 (JP) ..... 2003-191818

(51) Int. Cl.
*B41J 2/165* (2006.01)

(52) U.S. Cl. ..... 347/33; 347/23; 347/29; 347/32; 347/35

(58) Field of Classification Search ..... 347/22–35
See application file for complete search history.

(56) References Cited

U.S. PATENT DOCUMENTS 5,406,317 A * 4/1995 Shimamura et al. ..... 347/23
5,495,271 A * 2/1996 Koitabashi et al. ..... 347/23
5,793,388 A * 8/1998 Martinson et al. ..... 347/19
5,850,237 A * 12/1998 Slade ..... 347/23
5,896,143 A * 4/1999 Matsui et al. ..... 347/24

(Continued)

FOREIGN PATENT DOCUMENTS

EP 0271090 6/1988

(Continued)

OTHER PUBLICATIONS

EU Communication for Search Report dated Sep. 1, 2008 for EU Application No. 04747244.4-2304.

(Continued)

*Primary Examiner*—Shih-wen Hsieh
(74) *Attorney, Agent, or Firm*—Sonnenschein Nath & Rosenthal LLP

(57) ABSTRACT

In a liquid discharging apparatus for discharging droplets from a liquid discharge nozzle to a discharge object to be discharged and in a method for controlling the liquid discharging apparatus, cleaning effects for the ink discharge nozzle and the adjacent areas can be enhanced, and the time required for a series of performance maintaining operations can be reduced. The apparatus includes a platen plate for supporting recording paper as the discharge object, defining a positional relationship between the discharge object and the liquid discharge head, and receiving the droplets discharged from the liquid discharge head. Ink droplets are preliminarily discharged from the ink discharge nozzle to the platen plate.

29 Claims, 12 Drawing Sheets

U.S. PATENT DOCUMENTS 6,637,856 B2 * 10/2003 Nishi et al. ..... 347/29

FOREIGN PATENT DOCUMENTS

| | | |
|---|---|---|
| EP | 123576 | 9/2002 |
| JP | 08-310008 | 11/1996 |
| JP | 11-129487 | 5/1999 |
| JP | 2000-118058 | 4/2000 |
| JP | 2000-203041 | 7/2000 |
| JP | 2001-071521 | 3/2001 |
| JP | 2001-088375 | 4/2001 |
| JP | 2001-260375 | 9/2001 |
| JP | 2001-334679 | 12/2001 |
| JP | 2002-192756 | 7/2002 |
| JP | 2002-192777 | 7/2002 |
| JP | 2002-225311 | 8/2002 |
| JP | 2002-240309 | 8/2002 |
| JP | 2003-089226 | 3/2003 |
| JP | 2003-103793 | 4/2003 |
| JP | 2003-127353 | 5/2003 |

OTHER PUBLICATIONS

Communication pursuant to Article 94(3) EPC dated Jan. 5, 2009.
Japanese Office Action issued Oct. 24, 2006.

* cited by examiner

FIG. 7A
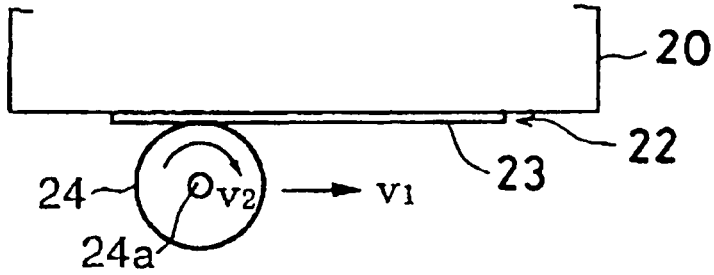
FIG. 7B
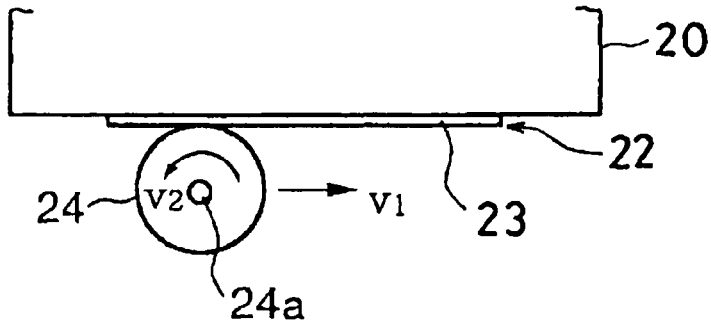
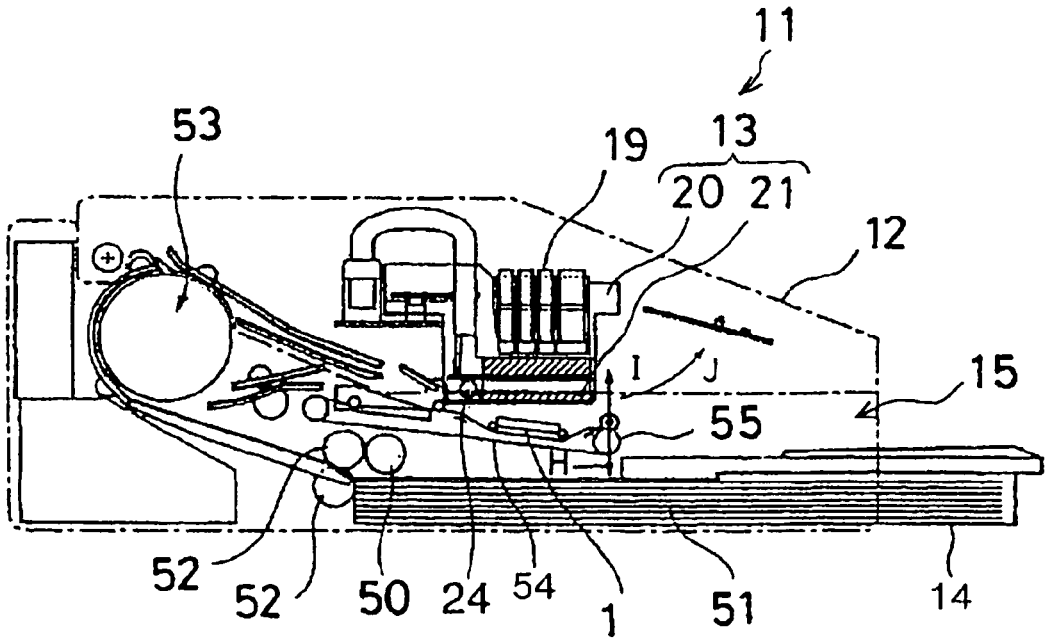
FIG. 8

LIQUID DISCHARGING APPARATUS AND CONTROL METHOD THEREFOR

TECHNICAL FIELD

The present invention relates to a liquid discharging apparatus for discharging droplets from a liquid discharge nozzle of a liquid discharge head to an object to be discharged and relates to a control method therefor.

BACKGROUND ART

Inkjet image forming apparatuses, for example, inkjet printers, have become widely available because of their low running costs, ease of colorization of a print image and miniaturization, and the like. Inkjet printers record an image by discharging small amounts of ink from tiny ink discharge outlets extending through an ink discharge surface of a print head. If print operation has not been performed for a long period of time and thus ink has not been discharged from the ink discharge outlets of the print head for such a long period, ink deposited on the ink discharge outlets formed through the ink discharge surface and the adjacent areas in the previous print operation may have been vaporized, dried, solidified, and hardened. This makes it difficult to properly discharge ink.

Conventionally, therefore, print-head cleaning is performed by pressing a blade, such as a relatively hard rubber one, against an ink discharge surface of a print head, sliding the blade over the ink discharge surface, and removing (wiping) solidified and hardened ink that has been deposited on the ink discharge surface. Relating to this, a technique is disclosed in which wiping effects are further enhanced by rotating a plurality of blades mounted on a rotating shaft (see, for example, Japanese Unexamined Patent Application Publication No. 57-034969 (pp. 2 to 3 and FIGS. 3 and 4)).

However, in the technique described in Japanese Unexamined Patent Application Publication No. 57-034969, since blades formed of a relatively hard rubber or the like are pressed against an ink discharge surface of a print head and slid over the ink discharge surface to wipe off ink deposited on the ink discharge surface, the ink discharge surface may be damaged by being subjected to a strong force applied by the blades. Additionally, the technique using the blades described above depends solely on wiping effects, but only performing wiping may cause ink to remain in ink discharge outlets. If a plurality of blades are used in order to wipe a line print head, in which a large number of ink discharge nozzles are arranged so as to correspond to the full width in a print area, problems arise in which an ink discharge surface may be damaged and ink may remain in ink discharge outlets and the adjacent areas, as in the above case.

Relating to this, Japanese Patent Application No. 2002-192236 discloses a technique in which an ink discharge outlet is cleaned by preliminarily discharging ink droplets to a cap member of a print head at a time when an image forming operation begins. Since the capacity of the cap member to hold ink is limited, this technique has a problem in which the cap member must be handled as a consumable item and replaced with a new one multiple times. Furthermore, since an area (range) for preliminarily discharging ink to the cap member is limited, the cap member must be moved several times for performing necessary preliminary discharge, and therefore, a problem arises in which an actual print time period is increased. Additionally, when continuous printing is performed, since an operation of moving the cap member and other operation are included, a problem arises in which the actual print time period is increased correspondingly.

DISCLOSURE OF INVENTION

The present invention aims to address the aforementioned problems. An object of the present invention is to provide a liquid discharging apparatus that does not damage a liquid discharge surface of a liquid discharge head, enhances cleaning effects of a liquid discharge nozzle, and reduces the time required for a series of performance maintaining operations and to provide a control method therefor.

To attain the object, a liquid discharging apparatus for discharging droplets from a liquid discharge nozzle to a discharge object to be discharged is provided. The liquid discharging apparatus includes a liquid discharge head having a liquid discharge surface provided with the liquid discharge nozzle. The liquid discharging apparatus includes a platen plate for supporting the discharge object, defining a positional relationship between the discharge object and the liquid discharge head, and receiving the droplets discharged from the liquid discharge head. In the liquid discharging apparatus, droplets are preliminarily discharged from the liquid discharge nozzle to the platen plate.

According to the liquid discharging apparatus, the liquid discharge surface of the liquid discharge head is not damaged, cleaning effects in the liquid discharge nozzle and the adjacent areas are enhanced, and the time required for a series of performance maintaining operations is reduced. As a result, the time required for a series of operations from wiping the liquid discharge surface to preliminarily discharging, which function as the performance maintaining operations of the liquid discharge head, is reduced, thus reducing a total print time.

BRIEF DESCRIPTION OF THE DRAWINGS

FIGS. 7A and 7B are illustrations schematically showing other embodiments of the cleaning roller.

FIG. 8 is a sectional view of the internal structure of the inkjet printer shown in FIG. 1 and illustrates an inactive state before the head cartridge starts operation.

BEST MODE FOR CARRYING OUT THE INVENTION

Embodiments of the present invention are described below with reference to the drawings.

Figure 1:
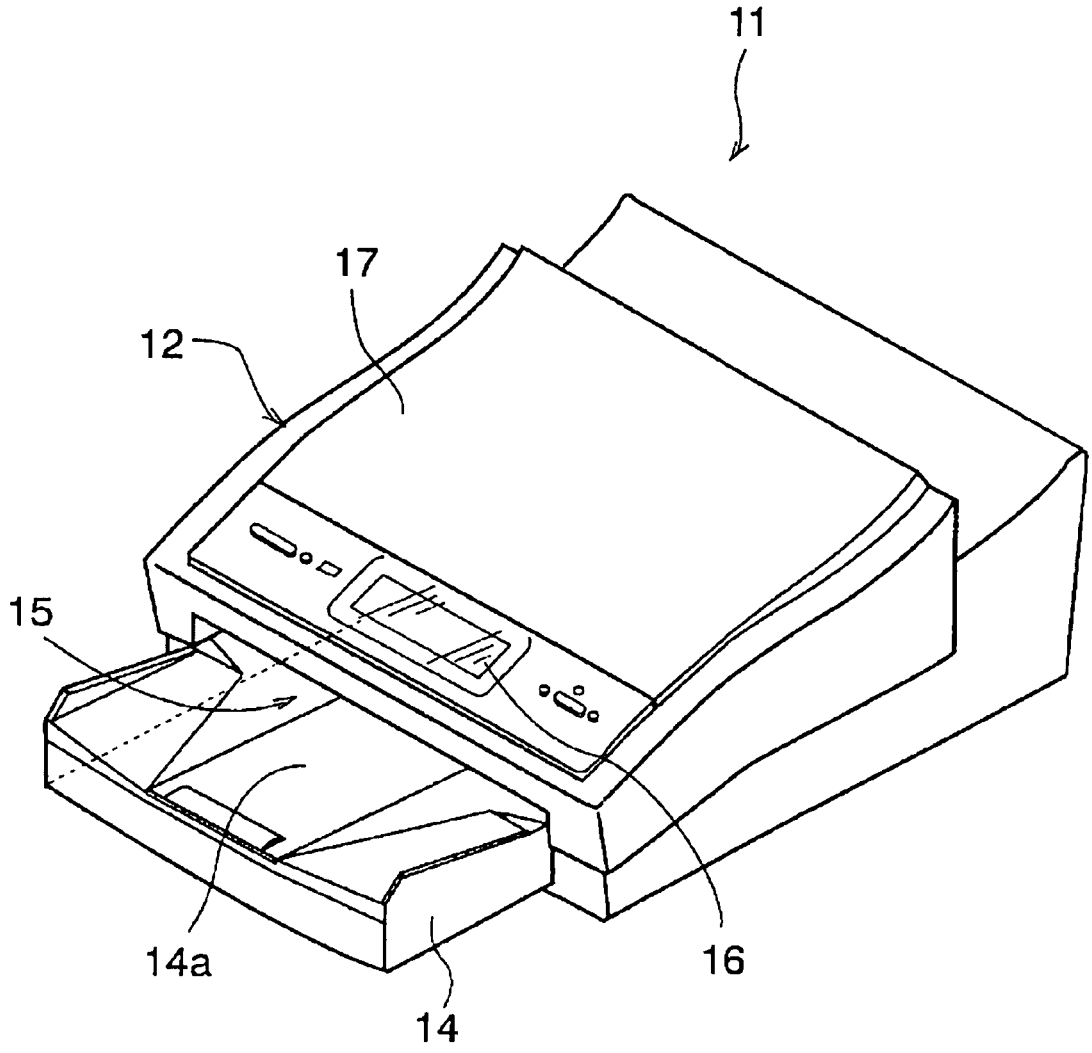
FIG. 1 is a schematic perspective view of an inkjet printer serving as a liquid discharging apparatus according to the present invention.

FIG. 1 is a perspective view of an embodiment of an inkjet printer as an example of a liquid discharging apparatus according to the present invention. This inkjet printer 11 is configured to form an image by discharging ink droplets to a predetermined point of a sheet of recording paper and includes a printer body 12, a head cartridge 13 (see FIG. 2), and a recording-paper tray 14.

The printer body 12 accommodates therein a conveyance mechanism for conveying recording paper held in the recording-paper tray 14 and an electric circuit for performing proper print on the recording paper, which serves as an object to be discharged. The recording-paper tray 14 is removably fit in a tray insertion slot 15 disposed at a lower front portion of the printer body 12. The tray insertion slot 15 also functions as a paper output slot. A sheet of recording paper that has been printed inside the printer body 12 is output onto a paper output receiving unit 14*a* disposed at the top of the recording-paper tray 14. A display panel (display unit) 16 for displaying the status of general operations of the inkjet printer 11 is disposed at an upper front portion of the printer body 12.

Figure 2:
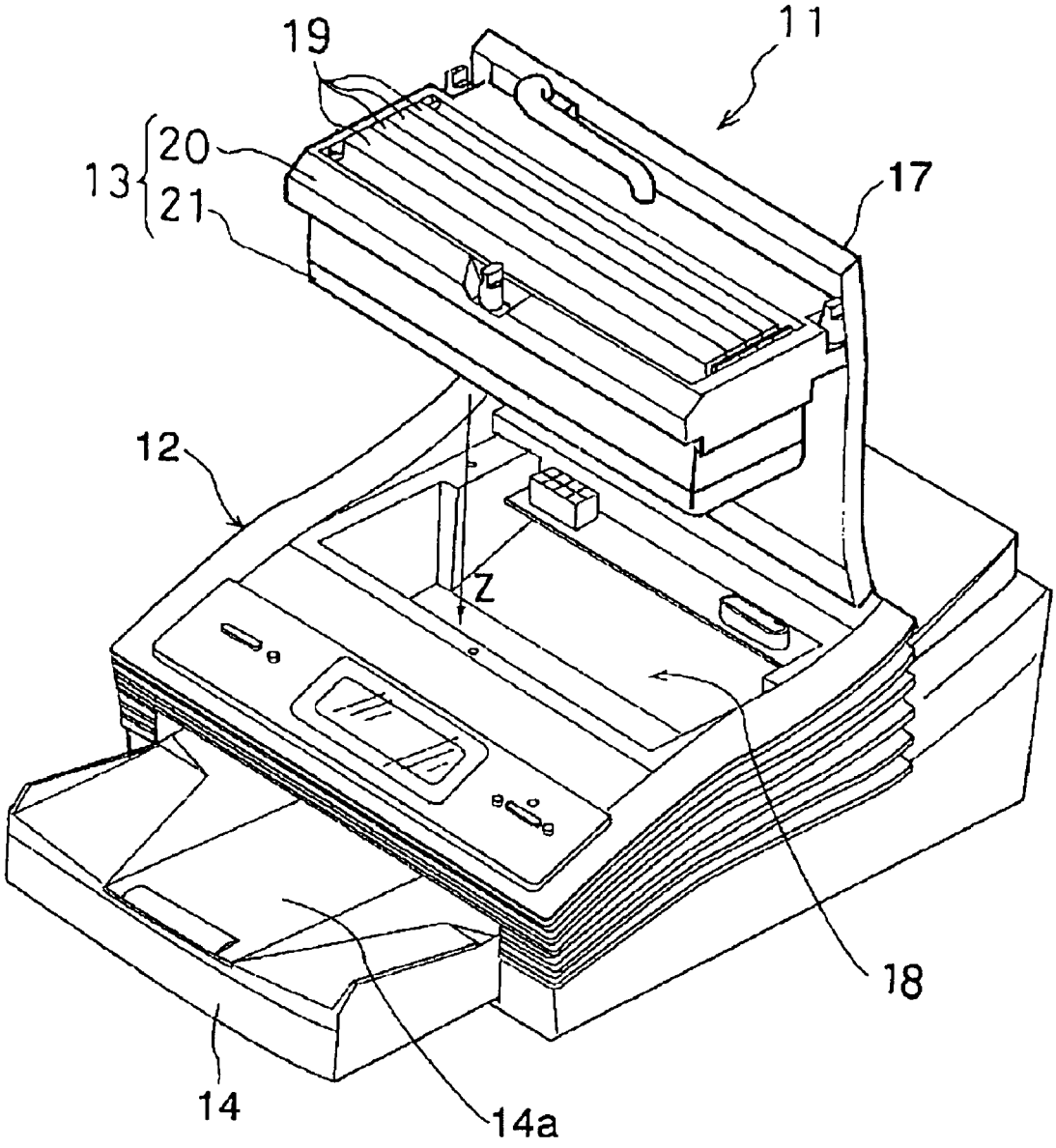
FIG. 2 is a perspective view showing how a head cartridge is accommodated in an accommodation unit with a top cover of the inkjet printer opened.

A top cover 17 is mounted on the top of the printer body 12 so as to be openable and closable. When the top cover 17 is opened, as shown in FIG. 2, an accommodation unit 18 for accommodating the head cartridge 13 is formed at an upper portion of the printer body 12. The head cartridge 13 is accommodated in the accommodation unit 18 of the printer body 12 in the direction indicated by the arrow Z so that the head cartridge 13 is removably held. The head cartridge 13 is composed of a print head 20 having an ink tank 19 corresponding to four colors, i.e., yellow (Y), magenta (M), cyan (C), and black (K), and a head cap 21 attached to a lower portion of the print head 20. The print head 20 is a full-line type print head, in which a row of ink discharge nozzles is arranged so as to correspond to the full width of a sheet of recording paper (e.g., A4-size paper) so that an image with a necessary width is formed by discharging ink on a sheet of recording paper in a state the print head 20 is stationary inside the accommodation unit 18 of the printer body 12.

Figure 3:
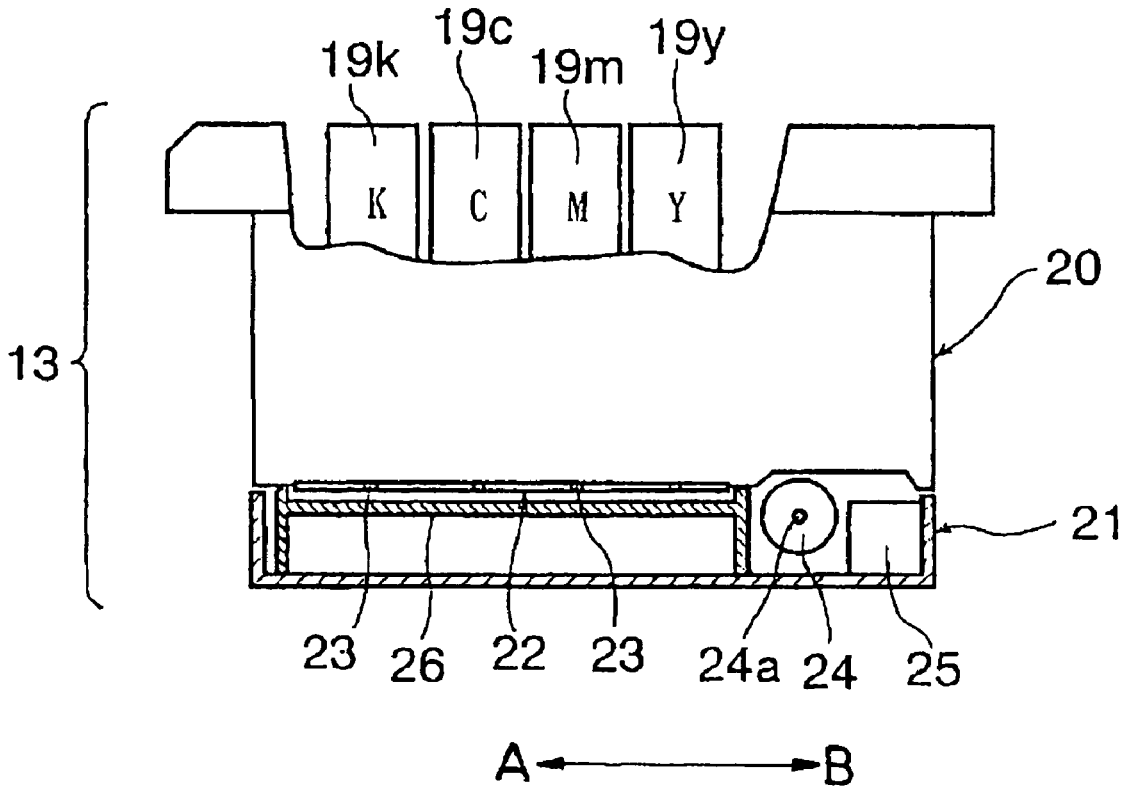
FIG. 3 is a partial sectional side view of a structure of the head cartridge in the liquid discharging apparatus.

FIG. 3 is a partial sectional side view of a structure of the head cartridge 13. The ink tank 19 is a liquid container that stores ink (predetermined liquid) and includes four tanks 19*y*, 19*m*, 19*c*, and 19*k* corresponding to inks of four colors, Y, M, C, and K, respectively, which are placed removably. The print head 20 is a liquid discharge head configured to receive ink from the ink tanks 19*y*, 19*m*, 19*c*, and 19*k* and discharge the ink and includes rows of ink discharge nozzles (liquid discharge nozzles) 23 corresponding to the inks of four colors Y, M, C, and K formed in an ink discharge surface 22 disposed at a lower portion thereof.

The head cap 21 is removably attached to a lower portion of the print head 20 so as to be relatively movable with respect to the print head 20. The head cap 21 functions to protect the ink discharge surface 22 of the print head 20 and typically has an elongated box shape with upright portions at four peripheral sides. The head cap 21 includes therein a cleaning roller (cleaning member) 24 for wiping deposited ink residues having an increased viscosity by moving over the ink discharge surface 22 and a liquid-waste receiving unit 25 for receiving ink preliminarily discharged from the ink discharge nozzles 23. The head cap 21 is moved along directions perpendicular to the longitudinal direction of the ink discharge surface 22 of the print head 20, i.e., along the directions indicated by the arrows A and B, by moving means, such as a motor. In a state where the head cap 21 has been moved in the direction indicated by the arrow A, the head cap 21 is removed from the print head 20. In a state where the head cap 21 has been returned in the direction indicated by the arrow B, the head cap 21 is attached to the print head 20 again. The head cap 21 is typically formed of a rigid resin.

The cleaning roller 24 is a cleaning member for cleaning the ink discharge surface 22 of the print head 20. The cleaning roller 24 is formed of a material that has elasticity and hygroscopicity, such as a sponge, and is of a cylindrical shape. The cleaning roller 24 is attached on one side of the head cap 21 in the direction of the length inside the head cap 21. Therefore, the cleaning roller 24 is parallel to the ink discharge surface 22 of the print head 20 in the direction of the length thereof. The cleaning roller 24 is configured to clean the ink discharge surface 22 of the print head 20 by moving together with the head cap 21.

The liquid-waste receiving unit 25 disposed at the inside of the head cap 21 is configured to receive ink droplets preliminarily discharged from the ink discharge nozzles 23 of the print head 20 and is formed of a material that has elasticity and hygroscopicity, such as a sponge. The liquid-waste receiving unit 25 receives preliminarily discharged ink droplets on a part or the entire part of the bottom of the shallow-box head cap 21. This can prevent ink preliminarily discharged from the ink discharge nozzles 23 of the print head 20 from splashing off the bottom of the head cap 21 and can absorb the preliminarily discharged ink so as not to be collected on the bottom of the head cap 21. As a result, preliminarily discharged ink is prevented from splashing off the liquid-waste receiving unit 25 and being redeposited on the ink discharge surface 22. Additionally, removing an ink absorbing member that has absorbed preliminarily discharged ink from the liquid-waste receiving unit 25 after an appropriate period of time of use, discarding the removed ink absorbing member, and placing a new ink absorbing member allows preliminarily discharged ink to be easily cleaned.

Reference numeral 26 denotes a nozzle sealing member disposed adjacent to the ink discharge surface 22 of the print head 20 inside the head cap 21. During usual nonprinting periods, the ink discharge nozzles 23 are hermetically protected by the head cap 21, thus preventing ink from drying.

Figure 4:
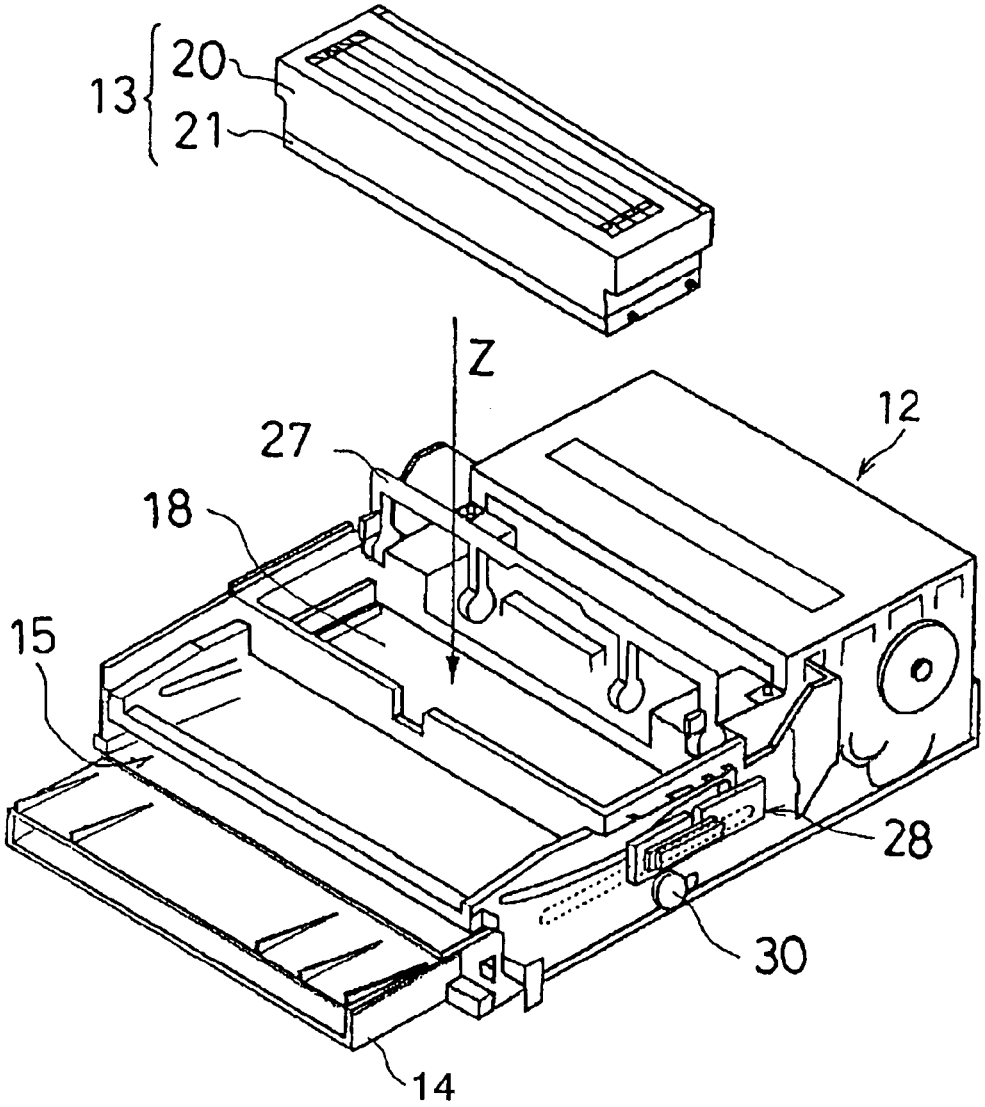
FIG. 4 shows an internal structure of a printer body shown in FIG. 3 with an outer cover removed.
Figure 5:
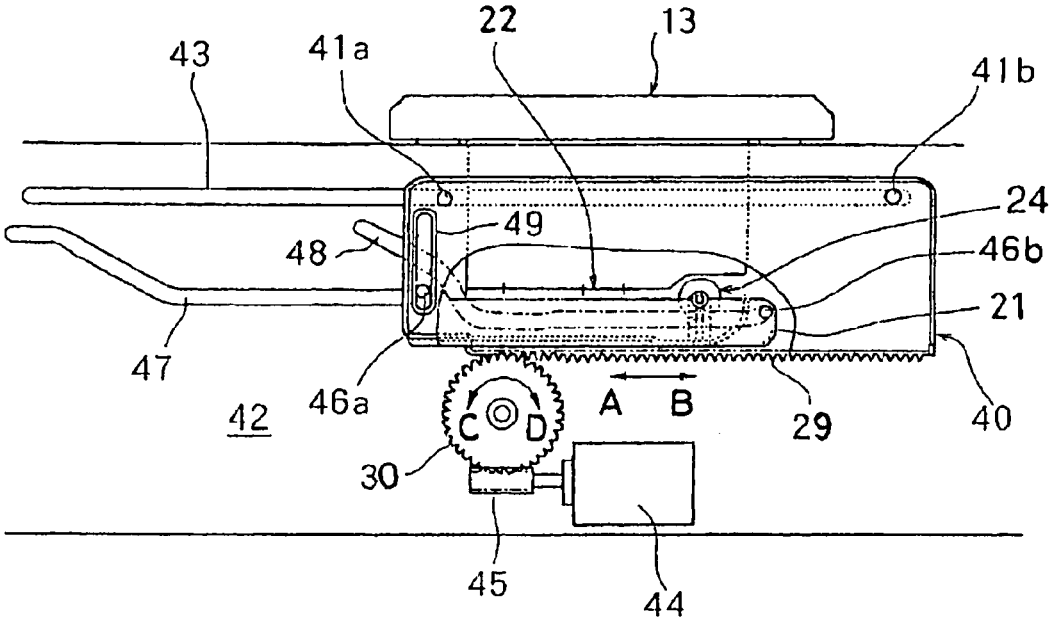
FIG. 5 shows a head cap opening and closing mechanism shown in FIG. 4.

The structure for moving the head cap 21 is described below with reference to FIGS. 4 and 5. FIG. 4 shows an internal structure of the printer body 12 shown in FIG. 2 with an outer cover removed. FIG. 5 shows a head cap opening and closing mechanism. In FIG. 4, after the head cartridge 13 is moved downwardly in the direction indicated by the arrow Z with respect to the printer body 12 and then accommodated in the accommodation unit 18, a head attaching and detaching mechanism 27 is tilted forward about 90 degrees to secure the head cartridge 13 to the printer body 12. At this time, the head cap 21 shown in FIG. 4 engages with a head cap opening and closing mechanism 28.

FIG. 5 is a side view showing in detail the head cap opening and closing mechanism 28 shown in FIG. 4. The head cap 21 to which the cleaning roller 24 shown in FIG. 3 is attached is supported by being coupled to a movement rack board 40 having a linear rack 29 formed at a lower side thereof shown in FIG. 5. The movement rack board 40 functions to move the head cap 21 in the directions indicated by the arrows A and B and is supported such that two guide pins 41*a* and 41*b* mounted on opposite ends of an upper portion of an inner periphery of the movement rack board 40 are engaged in a linear movement guide groove 43 formed on a first outer side wall 42 of the printer body 12 and such that the rack 29, which is formed at the lower side of the movement rack board 40, meshes with a pinion 30 rotated by a worm gear 45 on a rotating shaft of a movement motor 44 mounted to the first outer side wall 42.

The head cap 21 includes two cap guide pins 46*a* and 46*b*, which correspond to the front and the rear, respectively, protruding from a first outer side thereof toward the movement rack board 40. Two cap guide grooves 47 and 48 curved in a predetermined shape for providing a path over which the head cap 21 is moved are formed on an intermediated portion of the first outer side wall 42 of the printer body 12. The two cap guide pins of the printer body 12, i.e., the front cap guide pin 46*a* and rear cap guide pin 46*b*, engage with the cap guide grooves 47 and 48 of the first outer side wall 42 of the printer body 12, respectively. Only the front cap guide pin 46*a* engages with a vertically long guide groove 49 formed at a front end of the movement rack board 40.

The mechanism described above allows the pinion 30 to be rotated in the directions indicated by the arrows C and D via the worm gear 45 by driving of the movement motor 44, thus allowing the movement rack board 40 to be moved in the directions indicated by the arrows A and B via the rack 29, which engages with the pinion 30. At this time, since the front cap guide pin 46*a* of the head cap 21 engages with the guide groove 49 formed at the front end of the movement rack board 40, the head cap 21 is moved together with the movement rack board 40 in the directions indicated by the arrows A and B. The path over which the head cap 21 is moved at this time is defined by the shapes of the cap guide grooves 47 and 48 engaging with the two cap guide pins, i.e., the front cap guide pin 46*a* and the rear cap guide pin 46*b*.

Figure 6A:
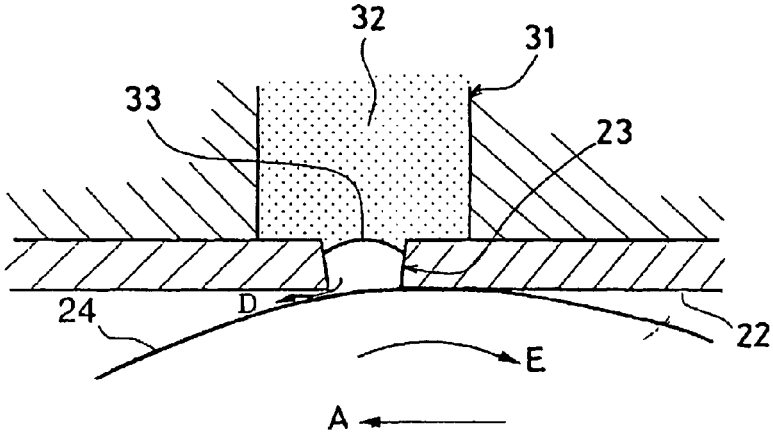
FIGS. 6A to 6C are enlarged sectional views for explaining cleaning effects of cleaning an ink discharge surface of a print head by using the cleaning roller.
Figure 6B:
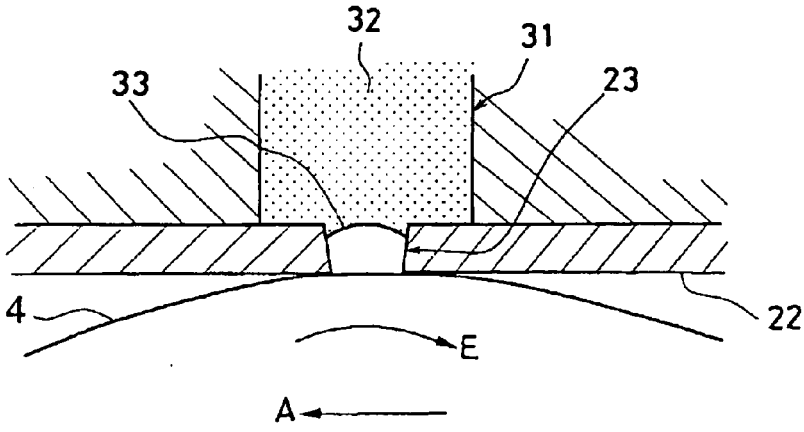
Figure 6C:
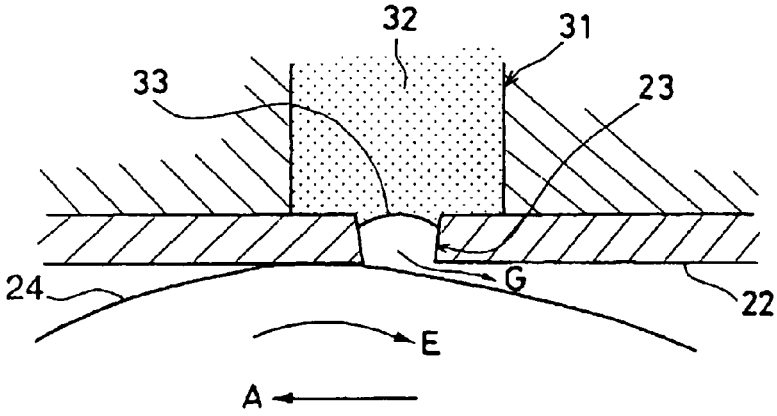

Here, a cleaning operation of the cleaning roller 24 to the ink discharge surface 22 of the print head 20 is now described with reference to FIGS. 6A to 6C. For the sake of simplifying explanation, FIGS. 6A to 6C illustrate in enlarged cross sectional view the ink discharge surface 22, the ink discharge nozzles 23, and the cleaning roller 24. First, in FIGS. 6A to 6C, while the cleaning roller 24 is moved together with the head cap 21 shown in FIG. 3 in the direction indicated by the arrow A, the cleaning roller 24 is rotated in the direction indicated by the arrow E by coupled driving caused by being in contact with the ink discharge surface 22. Then, the cleaning roller 24 passes over the position of a first row of the ink discharge nozzles 23 of the ink discharge surface 22 of the print head 20 shown in FIG. 3.

FIG. 6A shows a state in which the cleaning roller 24 that has been moved in the direction indicated by the arrow A while having been rotated by coupled driving in the direction indicated by the arrow E almost reaches the position of the first row of the ink discharge nozzles 23. At this time, the area of each of the ink discharge nozzles 23 is filled with ink 32 from an ink chamber 31, and a concave curved meniscus 33 is formed in the ink discharge nozzle 23 as a result of interfacial tension of a surface of the ink 32. As shown in FIG. 6A, by moving the cleaning roller 24 in the direction indicated by the arrow A while rotating the cleaning roller 24 in the direction indicated by the arrow E by coupled driving, an entrance of the ink discharge nozzle 23 is occluded from a first side end toward a second side end. During this movement, air present in the ink discharge nozzle 23 is gradually extruded from a space at the second side end as indicated by the arrow F.

Then, as shown in FIG. 6B, when the cleaning roller 24 is moved further in the direction indicated by the arrow A while being rotated by coupled driving in the direction indicated by the arrow E up to the position of the ink discharge nozzle 23, the ink discharge nozzle 23 is fully occluded. At this time, since the cleaning roller 24 is in contact with the ink discharge surface 22 while being pressed thereon, from a microscopic view, part of the surface of the cleaning roller 24 slightly enters the ink discharge nozzle 23 between the first side end and the second side end due to elasticity of the cleaning roller 24, and therefore, the cleaning roller 24 occludes the entrance of the ink discharge nozzle 23 in a state where the air present in the ink discharge nozzle 23 is extruded accordingly, so that the cleaning roller 24 encloses the inside of the ink discharge nozzle 23.

Then, as shown in FIG. 6C, the cleaning roller 24 is moved further in the direction indicated by the arrow A while being rotated by coupled driving in the direction indicated by the arrow E, so that the cleaning roller 24 gradually opens only the first side end in a state where the second side end of the ink discharge nozzle 23 is occluded. At this time, from a microscopic view, when the part of the surface of the cleaning roller 24 that has slightly entered the ink discharge nozzle 23 moves away from the first side end of the ink discharge nozzles 23, the air present in the enclosed ink discharge nozzle 23 is drawn and sucked from a gap at the first side end as indicated by the arrow G.

In other words, a change in pressure of the ink discharge nozzle 23 occurring when a first state in which the air present in the ink discharge nozzle 23 is slightly extruded and the ink discharge nozzle 23 is enclosed (positive pressure), as shown in FIG. 6B, is shifted to a second state in which the air present in the ink discharge nozzle 23 is drawn (negative pressure), as shown in FIG. 6C, causes the ink present in the ink discharge nozzle 23 to be sucked. As a result, suction for drawing ink remaining in the ink discharge nozzle 23 toward the outside of the print head 20 shown in FIG. 3 is exerted, and therefore, the ink present in the ink discharge nozzles 23 can be sucked and reliably removed.

In this case, since the cleaning roller 24 formed of an elastic material, such as rubber, and having a cylindrical shape is moved over the ink discharge surface 22, the ink discharge surface 22 can be cleaned without damaging a protective layer, in which a head electrode of the ink discharge surface 22 is covered with resin.

The cleaning roller 24 in the description above is rotated by coupled driving caused by being in contact with the ink discharge surface 22 of the print head 20. Alternatively, the cleaning roller 24 may be fixed so as not to be rotated by being in contact with the ink discharge surface 22. For example, in FIG. 3, if pins 24*a* on the opposite ends of the cleaning roller 24 are inserted into substantially U-shaped recesses of a holding member (not illustrated), the cleaning roller 24 is prevented from being rotated. In this case, since the cleaning roller 24 is moved while rubbing against the ink discharge surface 22, not only liquid ink deposited on the ink discharge surface 22 but also hardened stuck ink can be cleaned.

Moreover, the cleaning roller 24 may be rotated while rubbing against the ink discharge surface 22 of the print head 20 by being subjected to the restriction of the rotation imposed by a brake mechanism. For example, in FIG. 3, the brake mechanism has a mechanism in which the pins 24*a* on the opposite ends of the cleaning roller 24 are press-fitted in openings formed in an appropriate elastic body which is placed on which the pins 24*a* are held by the holding member or a mechanism in which the opposite end faces of the cleaning roller 24 are welded to the side faces of the elastic body by the application of pressure, and adequate brake force can occur when the cleaning roller 24 is rotated. In this case, since the cleaning roller 24 is slightly rotated while rubbing against the ink discharge surface 22, the ink discharge surface 22 is not damaged, and not only liquid ink deposited on the ink discharge surface 22 but also hardened stuck ink can be cleaned.

FIGS. 7A and 7B are illustrations schematically showing other embodiments of the cleaning roller 24. In this embodiment, the cleaning roller 24 is rotated by a rotation driving mechanism in the normal direction or the reverse direction. Specifically, in FIG. 3, the pins 24*a* of the cleaning roller 24 are engaged in a rotation shaft of a motor (not illustrated) disposed in the printer body 12 via a gear mechanism having an appropriate reduction ratio, and the cleaning roller 24 is driven so as to be actively rotated.

As shown in FIG. 7A, the cleaning roller 24 is rotated by the motor in the same direction as the direction of movement of the head cap 21 shown in FIG. 3, which is indicated by the arrow A, with a rotation speed satisfying that a peripheral speed of the cleaning roller 24, v2 is larger than a movement speed of the head cap 21, v1. In this case, friction occurs between the ink discharge surface 22 of the print head 20 and the periphery of the cleaning roller 24 on the basis of the difference between the speed of the ink discharge surface 22 of the print head 20 and the that of the periphery of the cleaning roller 24, thus reliably cleaning the ink discharge surface 22. Similarly, if the motor is rotated at a rotation speed satisfying that the movement speed v1 of the head cap 21 is larger than the peripheral speed v2 of the cleaning roller 24, friction occurs between the ink discharge surface 22 of the print head 20 and the periphery of the cleaning roller 24, as in the above case, thus reliably cleaning the ink discharge surface 22.

Alternatively, as shown in FIG. 7B, the cleaning roller 24 may be rotated in a direction that is opposite to the direction of movement of the head cap 21 shown in FIG. 3, which is indicated by the arrow A. In this case, friction occurs between the ink discharge surface 22 of the print head 20 and the periphery of the cleaning roller 24 on the basis of the difference between the movement directions thereof, thus reliably cleaning the ink discharge surface 22. Therefore, in the embodiments shown in FIGS. 7A and 7B, the ink discharge surface 22 is cleaned by new portions of the periphery supplied in succession from active rotation of the cleaning roller 24.

Figure 9:
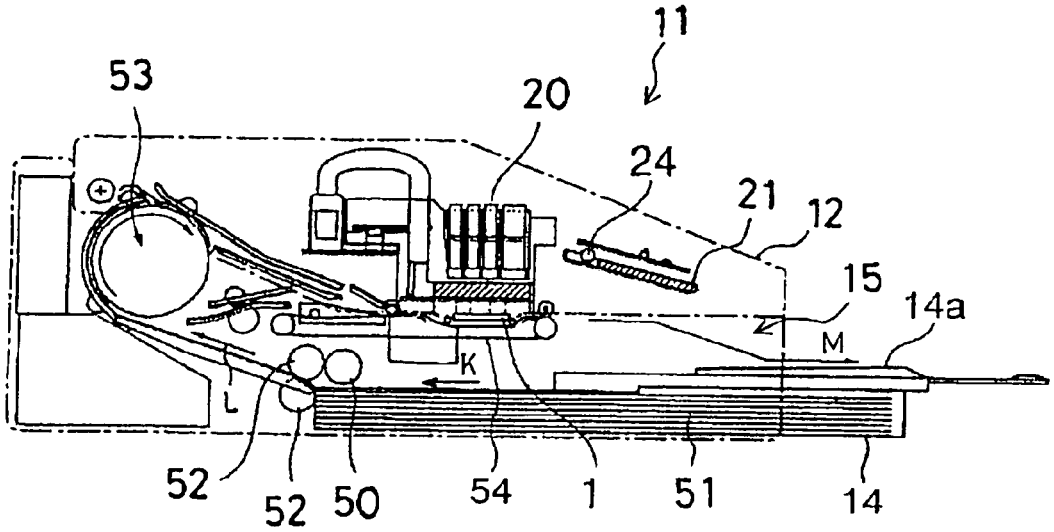
FIG. 9 shows a state in which a cap that hermetically protected the ink discharge surface of the head cartridge is withdrawn up to a withdrawal position and thus a print operation is allowed to start.

FIG. 8 is a sectional view of a specific example of the internal structure of the inkjet printer 11 and illustrates an inactive state before the head cartridge 13 starts operation. FIG. 9 shows a state in which the head cap 21 that hermetically protected the ink discharge surface 22 of the print head 20 has been withdrawn up to a cap withdrawal position and thus a print operation is allowed to start. As shown in FIG. 8, in the inkjet printer 11, paper feeding means 50 including a roller is disposed above a leading end in the direction of insertion of the recording-paper tray 14 fit in the tray insertion slot 15 disposed at the lower front portion of the printer body 12 so as to supply a sheet of recording paper 51 whenever necessary. In the direction of supply of the recording paper 51, separating means 52 including two rollers opposed to each other is disposed so as to supply the recording paper 51 on a one-by-one basis by separating one from the other sheets of the recording paper 51, which are overlaid and accommodated in the recording-paper tray 14. Furthermore, a reverse roller 53 for reversing the direction of conveyance of the recording paper 51 is disposed at an upper portion of the printer body 12 in a forward part in the direction of conveyance of a sheet of the recording paper 51 separated by the separating means 52.

Belt conveying means 54 and the platen plate 1 are disposed at a forward part in the direction of conveyance of the sheet of recording paper 51 reversed by the reverse roller 53. As shown in FIG. 8, in a state where a print operation is inactive, a leading end 55 of the belt conveying means 54 is placed downward in the direction indicated by the arrow H, so that a large gap is present between the lower face of the print head 20 and the belt conveying means 54. As shown in FIG. 9, in a state where a print operation is allowed, the leading end 55 of the belt conveying means 54 is placed upward in the direction indicated by the arrow I so as to be maintained in a horizontal position, so that a path for the recording paper with a small gap is present between the lower face of the print head 20 and the belt conveying means 54.

In a state where a print operation is inactive, as shown in FIG. 8, the lower face of the print head 20 is closed by the head cap 21, thus preventing the ink discharge nozzles 23 from being clogged with dried ink in the ink discharge nozzles 23. The head cap 21 includes the cleaning roller 24, and as the head cap 21 is withdrawn up to a predetermined withdrawal position for the head cap 21 (see FIG. 9) before the print operation begins, the ink discharge nozzles 23 is cleaned.

Figure 10:
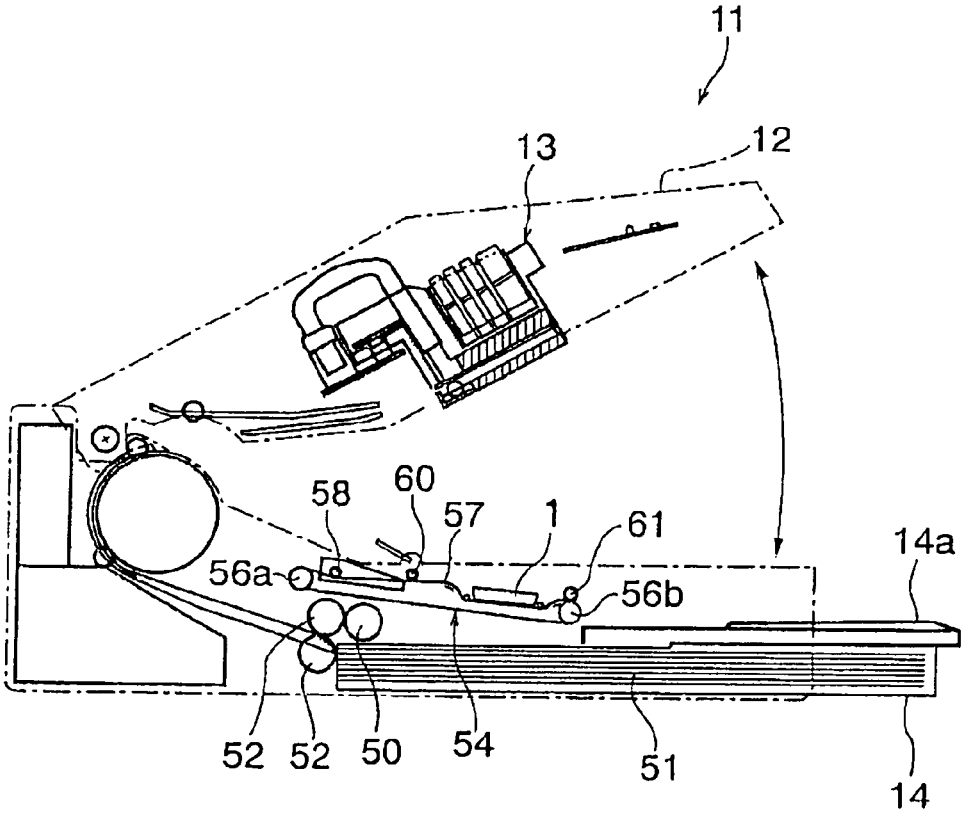
FIG. 10 shows a state in which the printer body is open for maintenance of the inkjet printer.

As shown in FIG. 10, the inkjet printer 11 having the structure described above has a mechanism for opening the printer body 12 for maintenance, and therefore, the inkjet printer 11 can clear a paper jam and address other problems. The belt conveying means 54 includes a conveyer belt 57 stretched between two main pulleys 56*a* and 56*b*, and a tension roller 58 for adjusting the tension of the conveyer belt 57 is disposed therebetween. A guiding plate and a pinch roller 60 which are opposed to each other are disposed at a side of supplying the recording paper 51 with respect to the print head 20. A spur roller 61 is disposed at a side of outputting the recording paper 51. As a result, a predetermined path over which the recording paper 51 is conveyed is formed.

Figure 11A:
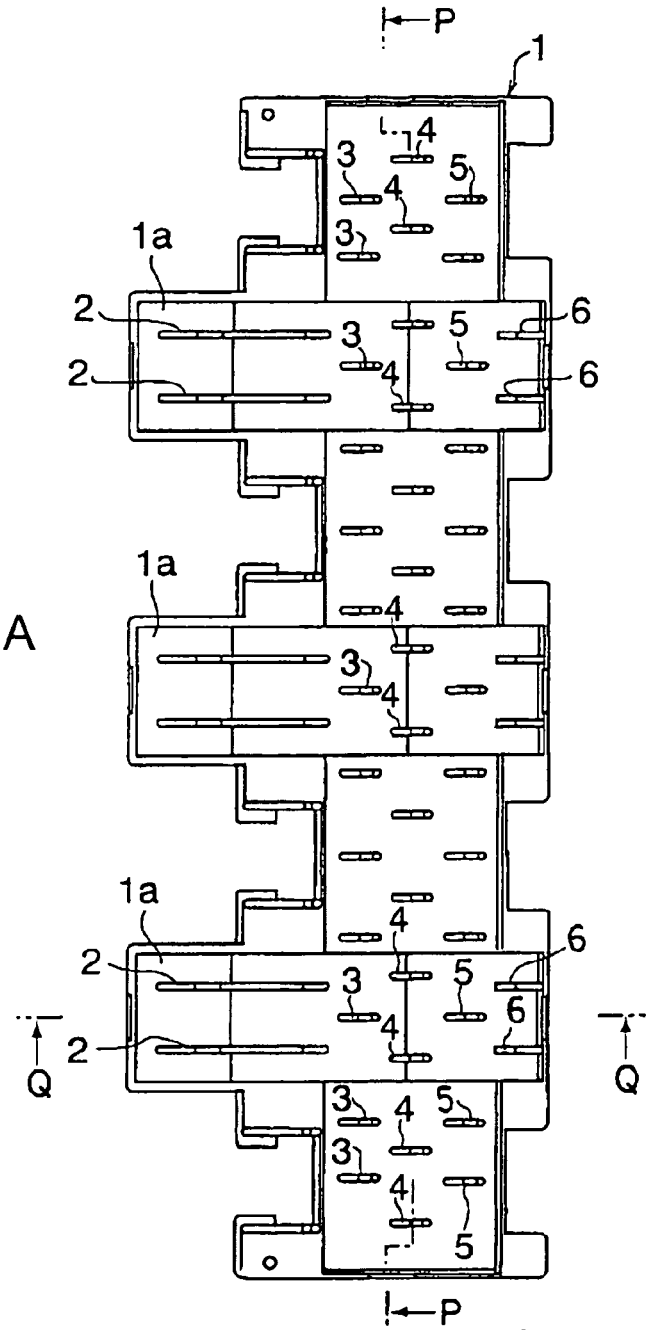
FIGS. 11A to 11C are illustrations showing a platen plate disposed below the head cartridge of the inkjet printer according to an embodiment.
Figure 11B:
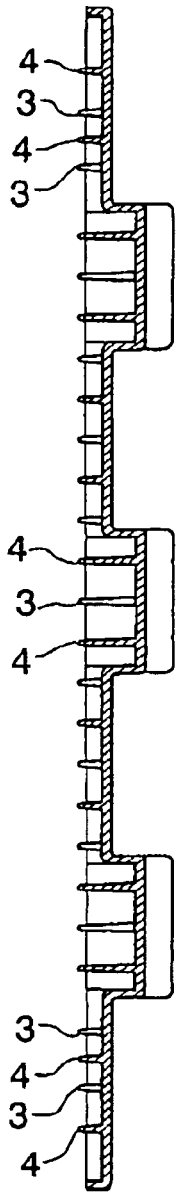
Figure 11C:
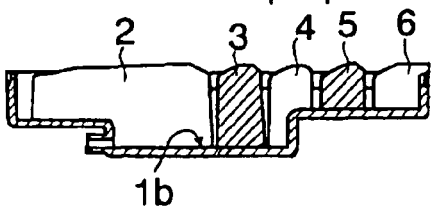

The platen plate 1 is disposed above the belt conveying means 54. As shown in FIG. 11A, the platen plate 1 has a width that corresponds to the direction of the full width of the ink discharge surface 22 of the print head 20, and has an elongated box shape with upright portions at the periphery of the platen plate 1. The overall structure of the platen plate 1 is formed of an acrylonitrile butadiene styrene (ABS) resin. In the platen plate 1, projections 1*a* are disposed upstream in the direction of conveyance of the recording paper 51 so that stability of the conveyance of the recording paper 51 is maintained and discharged ink droplets are sufficiently stored. As shown in FIG. 11C, ribs 2 to ribs 6 are arranged in a standing condition on a bottom 1*b* and extend in the direction of conveyance of the recording paper 51. As shown in FIG. 11A, the ribs 2 to ribs 6 are arranged in the direction of width of the platen plate 1 at predetermined intervals.

Figure 12:
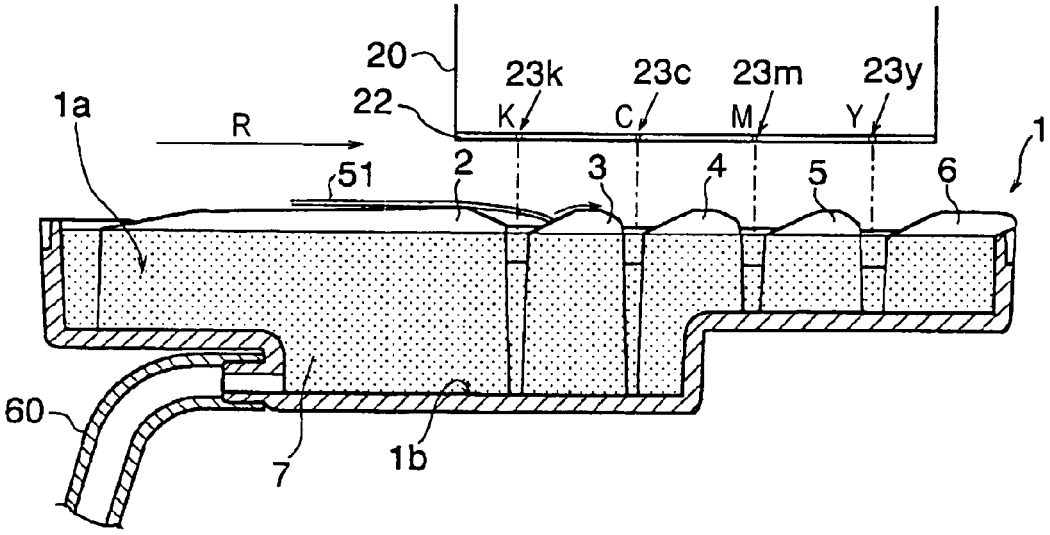
FIG. 12 is a sectional view showing how a sheet of recording paper is conveyed over top faces of ribs arranged on the platen plate.

As shown in FIG. 12, the platen plate 1 is disposed opposite to the ink discharge surface 22 disposed at the lower face of the print head 20. The platen plate 1 is a member for supporting, from the back of the recording paper 51, the recording paper 51 on which ink droplets discharged from the ink discharge nozzles 23 for the colors (23*k*, 23*c*, 23*m*, and 23*y*) arranged in the ink discharge surface 22 are to be deposited. The platen plate 1 also serves as an ink reservoir for receiving and storing excessive ink droplets discharged beyond edges of the recording paper 51. The platen plate 1 is removable in order to increase ease of maintenance. Therefore, when the platen plate 1 is stained with ink, the platen plate 1 can be removed and readily cleaned.

Figure 13:
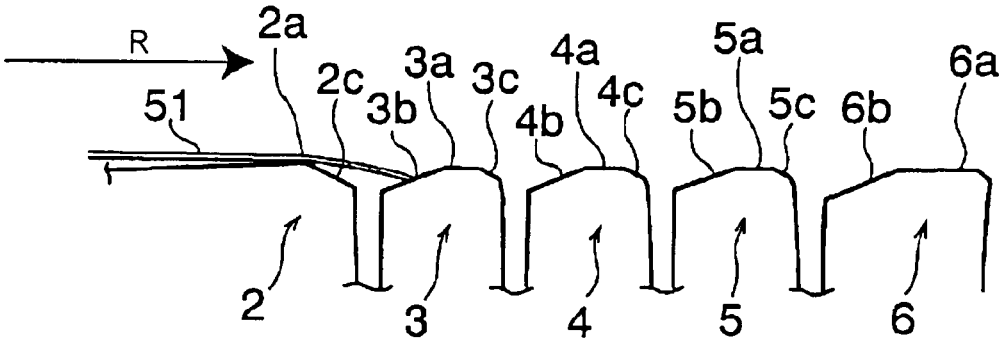
FIG. 13 is a sectional view showing the shape of the ribs of the platen plate.

As shown in FIGS. 12 and 13, the ribs 2 to ribs 6 of the platen plate 1 function to support the back of the recording paper 51, and the first ribs 2 to the fifth ribs 6 are disposed from the upstream side to the downstream side in the direction of conveyance of the recording paper 51. The heights of the rib top surfaces 2*a* to the rib top surfaces 6*a* corresponding to the ribs 2 to ribs 6 are substantially the same as each other. The rib top surfaces 2*a* to 6*a* are formed so as to support the back of the recording paper 51 at an area outside a deposit area on which the ink droplets discharged from the ink discharge nozzles 23 of the ink discharge surface 22 are deposited and to define the distance between the recording paper 51 and the ink discharge surface 22. No ribs are present in the deposit area on which the ink droplets discharged from the ink discharge nozzles 23 of the ink discharge surface 22 are deposited.

Therefore, the plurality of ribs 2 to ribs 6 of the platen plate 1 arranged in such a way described above support the back of the recording paper 51 at the area outside the deposit area on which the ink droplets discharged from the ink discharge nozzles 23 of the ink discharge surface 22 are deposited and define the distance between the recording paper 51 and the ink discharge surface 22, and the ribs 2 to ribs 6 are not present within the deposit area on which the ink droplets discharged from the ink discharge nozzles 23 of the ink discharge surface 22 are deposited, so that the rib top surfaces are not in contact with the back of the recording paper 51. As a result, the plurality of ribs 2 to ribs 6 arranged in the direction of width of the platen plate 1 at predetermined intervals maintain the flatness of the recording paper 51 that has been conveyed under the ink discharge surface 22 of the print head 20, thus allowing ink to be properly discharged to the surface of the recording paper 51. Additionally, the top surfaces of the ribs 2 to ribs 6 are not stained with ink discharged beyond the peripheral edges of the recording paper 51, thus preventing the back of the recording paper 51 from being stained.

In the aforementioned description, the platen plate 1 includes no rib within the deposit area on which the ink droplets discharged from the ink discharge nozzles 23 are deposited. However, the present invention is not limited to this structure. The platen plate 1 may include a rib (not illustrated) within the deposit area in such a way that the rib has a height satisfying that the rib top surface is not in contact with the back of the recording paper 51.

As shown in FIG. 13, each of the ribs 2 to ribs 6 has an inclined slope that is disposed at an upstream side end thereof in the direction of conveyance of the recording paper 51 and that functions to guide the leading edge of the recording paper 51 that has been conveyed from the upstream to the rib top surface. For example, each of the second ribs 3 has an inclined slope 3*b* which are large chamfers at the upstream side end, so that the leading edge of the recording paper 51 that has been conveyed in the direction indicated by the arrow R is guided to each of the rib top surfaces 3*a*. Therefore, when the recording paper 51 with the leading edge tilted downward is conveyed, the leading edge is guided to the rib top surface 3*a* by the inclined slop 3*b* of the rib 3, thus preventing the occurrence of a paper jam. In particular, in the case of borderless printing, for example, when ink droplets are discharged to the leading edge of the recording paper 51, the leading edge of the recording paper 51 tends to be bent and thus tilted downward. Since the inclined slop 3*b* is formed at the upstream side end of the second rib 3, the leading edge of the recording paper 51 is guided to the rib top surface 3*a* by the rib top surface 3*a*, thus preventing the occurrence of a paper jam. The third ribs 4 to the fifth ribs 6 have a shape similar to that of the second rib 3.

As a result, when the recording paper 51 that has passed over the rib top surface 3*a* of the second rib 3 is further conveyed in the direction indicated by the arrow R, even if the recording paper 51 with the leading edge tilted downward enters between the second rib 3 and the third rib 4, the recording paper 51 can be guided to the rib top surface 4*a* without stopping on the upstream side end of the third rib 4 and then conveyed to the fourth rib 5 and the fifth rib 6 in order. In this way, the recording paper 51 can be conveyed by being supported by the rib top surfaces 2*a* to 6*a* while the distance between the recording paper 51 and the ink discharge surface 22 is maintained constant.

As shown in FIG. 13, inclined slopes 2*c* to 5*c* similar to the above slopes are formed at the downstream side ends of the first ribs 2 to the fourth ribs 5, respectively. Therefore, although not illustrated in the Figures, even when the recording paper 51 is conveyed in a direction opposite to the direction indicated by the arrow R, the leading edge in the direction of the conveyance can be prevented from stopping on the downstream side ends of the ribs 2 to 5. This can prevent the occurrence of a paper jam when the recording paper 51 is conveyed in the direction opposite to the direction indicated by the arrow R. In the aforementioned description, the ribs 2 to ribs 6 include the inclined slopes at the upstream side ends thereof. However, the present invention is not limited to this structure. The ribs 2 to ribs 6 may be of any shape as long as the shape can prevent the occurrence of a paper jam of the conveyed recording paper 51.

Figure 14:
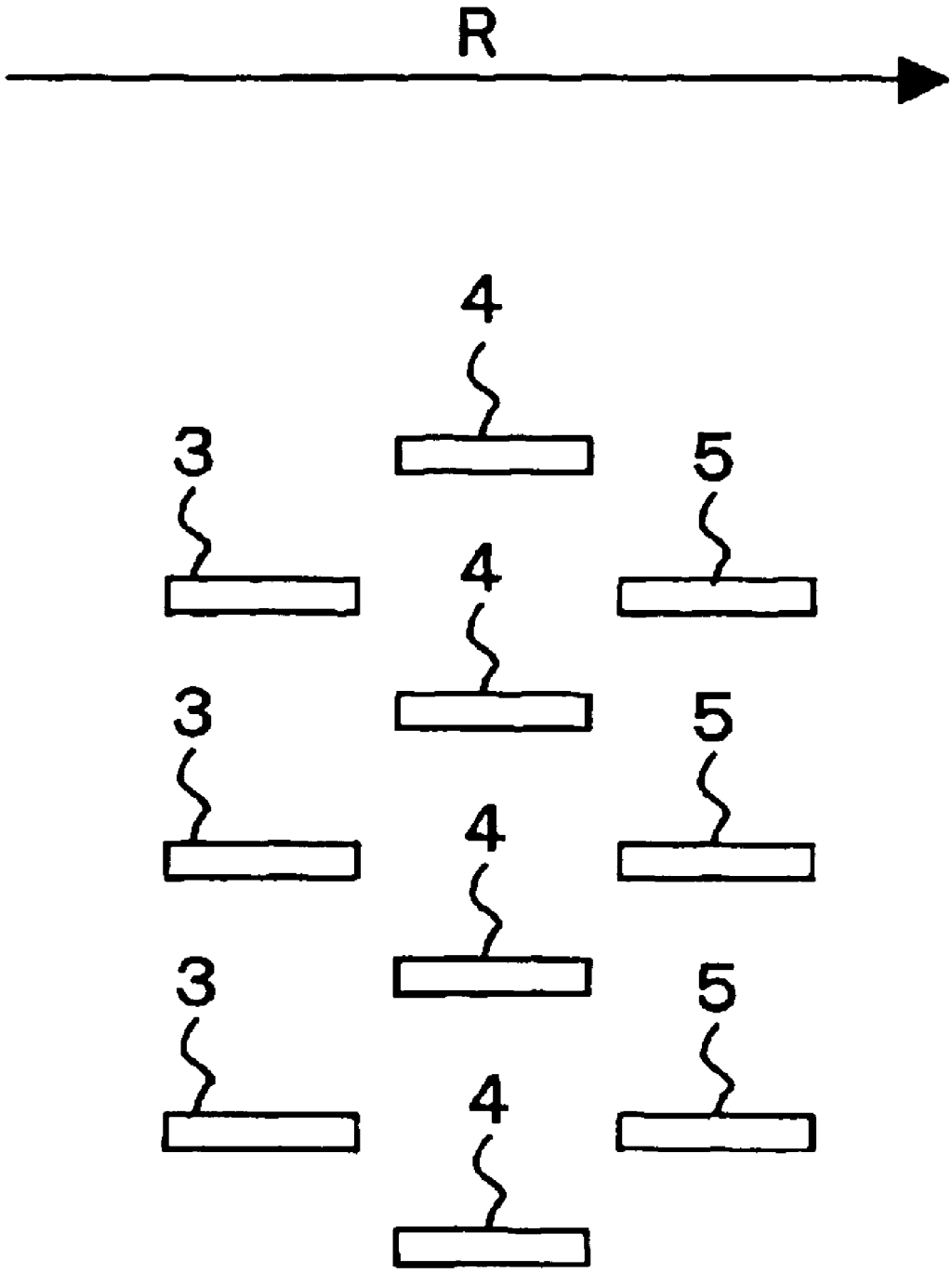
FIG. 14 is a plan view showing how the ribs of the platen plate are arranged.

Furthermore, as shown in FIG. 11A, the plurality of ribs 2 to ribs 6 of the platen plate 1 are arranged such that the rib top surfaces at adjacent rows in the upstream side or the downstream side are displaced in relation to one another. More specifically, as shown in FIG. 14, the row of the third ribs 4 arranged in the direction of width at predetermined intervals is not aligned with the row of the second ribs 3 arranged at the upstream side and the row of the fourth ribs 5 arranged at the downstream side in the direction of conveyance of the recording paper 51, which is indicted by the arrow R.

Therefore, since the recording paper 51 is supported by the ribs 2 to ribs 6 in the arrangement described above, the flatness of the recording paper 51 in the direction of width thereof is maintained. This can prevent an increase of the distance between the recording paper 51 and the ink discharge surface 22 resulting from bending of the recording paper 51, thus allowing a proper ink discharge. In addition, when the ribs 2 to ribs 6 are disposed in the arrangement described above, the distances between the ribs are maintained. As a result, a mold used in molding the platen plate 1 becomes less broken. The arrangement of the ribs 2 to ribs 6 is not limited to that shown in FIG. 14. The arrangement of the ribs 2 to ribs 6 may be of any shape as long as it can maintain the flatness of the recording paper 51 in the direction of width thereof.

Moreover, as shown in FIG. 12, the platen plate 1 includes an ink absorber 7 within the deposit area on which the ink droplets discharged from the ink discharge nozzles 23 of the ink discharge surface 22 are deposited. The ink absorber 7 functions as a liquid absorber for absorbing the ink droplets discharged from the ink discharge nozzles 23. The ink absorber 7 is typically formed of a sponge and is configured to absorb any ink droplets discharged beyond the peripheral edges of the recording paper 51 when, for example, borderless printing is performed. This can reduce splashes of ink droplets vigorously discharged from the ink discharge nozzles 23, thus contributing to preventing the back of the recording paper 51 from being stained. Additionally, the provision of the ink absorber 7 can prevent spills of liquid ink caused by vibration, even when the ink is collected to some extent.

As shown in FIG. 12, a waste ink tube 60 is mounted to the bottom 1*b* of the platen plate 1. The waste ink tube 60 is formed such that ink preliminarily discharged from the ink discharge nozzles 23 that has been absorbed in the ink absorber 7 flows out of the platen plate 1 through the waste ink tube 60. Therefore, if a large amount of ink is discharged, the ink is prevented from spilling from the platen plate 1, thus avoiding the ribs 2 to ribs 6 from being stained with ink. The ink ejected from the waste ink tube 60 is collected in a waste ink tank (not illustrated).

The platen plate 1 may be formed such that the ink preliminarily discharged from the ink discharge nozzles 23 is drained out of the platen plate 1 by being forcefully sucked or pressed. In this case, the waste ink tube 60 has a suction mechanism (not illustrated), and the waste ink may be collected in the waste ink tank with the suction mechanism.

An operation of the inkjet printer 11 having the structure described above is now described. First, as shown in FIG. 2, when the top cover 17 at the top of the printer body 12 is opened, then the print head 20 is accommodated in the accommodation unit 18 in the direction indicated by the arrow Z. The recording-paper tray 14 is attached by being inserted into the tray insertion slot 15 disposed at the lower front portion of the printer body 12. At this time, as shown in FIG. 8, inside the printer body 12, the leading end 55 of the belt conveying means 54 is placed downward in the direction indicated by the arrow H, and the lower face of the print head 20 is closed with the head cap 21. Therefore, the inkjet printer 11 is in a state in which a print operation is inactive.

Then, when a control signal indicating starting of printing is input, the head cap 21 is moved in the direction indicated by the arrow J shown in FIG. 8 up to a predetermined withdrawal position for the head cap. At this time, as shown in FIGS. 15A to 15F, as the head cap 21 is moved up to the withdrawal position, the cleaning roller 24 cleans the ink discharge nozzles 23 by sliding over the nozzle member 2 of the print head 20.

Figure 15A:
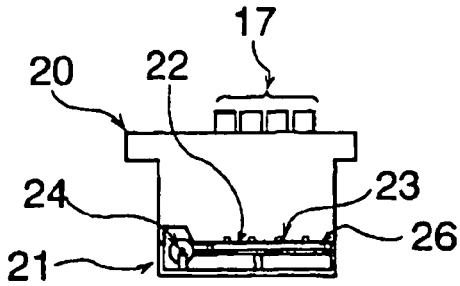
FIGS. 15A to 15F are illustrations showing a series of cleaning operations while a head cap is moved by the head cap opening and closing mechanism.

A cleaning operation occurring when the head cap 21 is moved is now described with reference to FIGS. 15A to 15F. FIG. 15A shows a state in which the head cap 21 is in a closed position with respect to the ink discharge surface 22 of the print head 20 in an initial state so that the ink discharge nozzles 23 corresponding to the inks of the four colors Y, M, C, and K in the ink discharge surface 22 are protected by the nozzle sealing member 26.

Figure 15B:
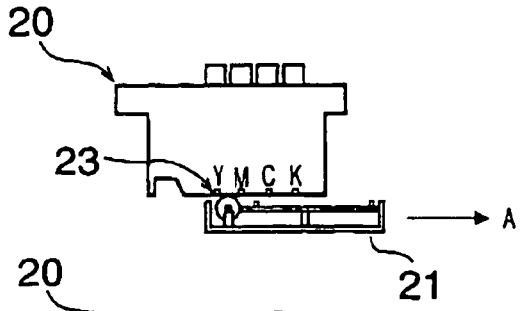

In this state, when a cap opening trigger signal is input to the printer body 12 at startup of the printer, at start of printing, upon an instruction from a user, or other action, the movement motor 44 shown in FIG. 5 is rotationally driven, thus causing the head cap 21 to start moving in the direction indicated by the arrow A, as shown in FIG. 15B. At this time, as the head cap 21 is moved, the cleaning roller 24, which is formed of, for example, a sponge, is moved while being continuously rotated by coupled driving and rubbing against the ink discharge surface 22 by being in contact therewith in a state where the cleaning roller 24 is pressed on the ink discharge surface 22, while the rotation of the cleaning roller 24 is restricted by the brake mechanism, or while the cleaning roller 24 is rotated in the normal direction or the reverse direction by the motor. While the cleaning roller 24 is rotated and moved, hardened ink residues having an increased viscosity present within the ink discharge nozzles 23 corresponding to the inks of the four colors Y, M, C, and K are wiped off by the cleaning roller 24.

Figure 15C:
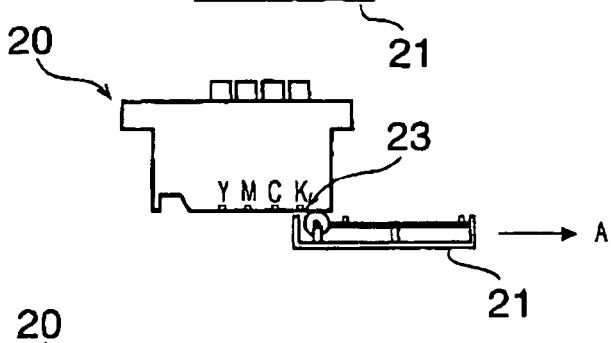

Here, in order to prevent clogging of the ink discharge nozzles 23, when an optical, mechanical, or other type of sensor (not illustrated) detects that the liquid-waste receiving unit 25 (see FIG. 3) has reached a point directly below the ink discharge nozzles 23 after the cleaning roller 24 wipes the ink residues off, ink may be preliminarily discharged to the liquid-waste receiving unit 25. FIG. 15B shows a state in which, after the cleaning roller 24 cleans ink residues of the ink discharge nozzles 23 for yellow (Y), ink is preliminarily discharged to the liquid-waste receiving unit 25 that has reached a point directly below the ink discharge nozzles 23 for yellow (Y). FIG. 15C shows a state in which, after the cleaning roller 24 cleans ink residues of the ink discharge nozzles 23 for black (K), ink is preliminarily discharged to the liquid-waste receiving unit 25 that has reached a point directly below the ink discharge nozzles 23 for black (K).

Figure 15D:
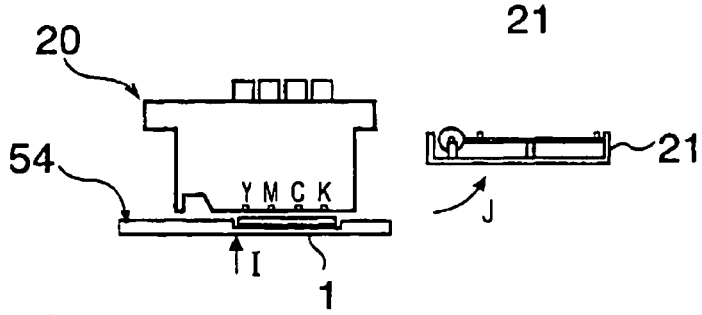

In a state where wiping with the cleaning roller 24 and preliminary discharging of ink with respect to all the ink discharge nozzles 23 for the four colors Y, M, C, and K has completed in this way, as shown in FIG. 15D, the head cap 21 is fully moved in the direction indicated by the arrow A and then moved in the direction indicated by the arrow J, so that the head cap 21 is maintained in a withdrawal position of the head cap. In this state, when the belt conveying means 54 is moved upward in the direction indicated by the arrow I up to a position where the belt conveying means 54 can convey the recording paper 51, the printer body 12 and the head cartridge 13 are in a state where a print operation is allowed. Here, at a time when an operation of discharging ink begins, ink droplets are preliminarily discharged from the ink discharge nozzles 23 to the platen plate 1. Therefore, the ink discharge surface 22 of the print head 20 can be prevented from being damaged, cleaning effects for the ink discharge nozzles 23 and the adjacent areas can be enhanced, and the time required for a series of performance maintaining operations can be reduced. After the ink droplets are preliminarily discharged to the platen plate 1, the recording paper 51 is conveyed while being supported by the ribs of the platen plate 1, and the recording paper 51 is printed in this state.

More specifically, in a state where a print operation is allowed, as shown in FIG. 9, the paper feeding means 50 is driven and then the recording paper 51 overlaid and accommodated in the recording-paper tray 14 is supplied in the direction indicated by the arrow K. At this time, the recording paper 51 is supplied on a one-by-one basis by being separated from the other sheets by the separating means 52 in the direction indicated by the arrow L wherever necessary. The supplied sheet of the recording paper 51 is then conveyed to the belt conveying means 54 while the direction of conveyance is reversed by the reverse roller 53. The sheet of the recording paper 51 is then conveyed to a portion under the print head 20 by the belt conveying means 54.

Furthermore, when the sheet of the recording paper 51 reaches the portion under the print head 20, a print signal is input. In response to the print signal, a predetermined heat element in the print head 20 is driven. The ink droplets are discharged from the rows of the ink discharge nozzles 23 corresponding to the inks of the four colors to the sheet of the recording paper 51 that has been conveyed at a constant speed, and therefore, a color print image is formed on the sheet of the recording paper 51.

Figure 15E:
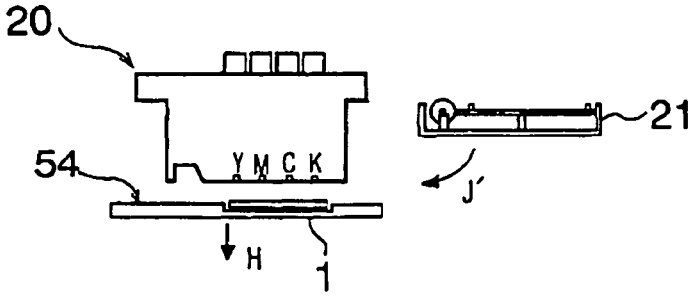

When printing of the predetermined number of pages has completed, a cap closing trigger signal is input to the printer body 12. As shown in FIG. 15E, the belt conveying means 54 is moved downward in the direction indicated by the arrow H, the movement motor 44 shown in FIG. 5 is rotated in the reverse direction, the head cap 21 is moved from the withdrawal position of the head cap in the direction indicated by the arrow J' along the same route as that used to reach the withdrawal position, and as a result, the head cap 21 returns to the initial position.

Figure 15F:
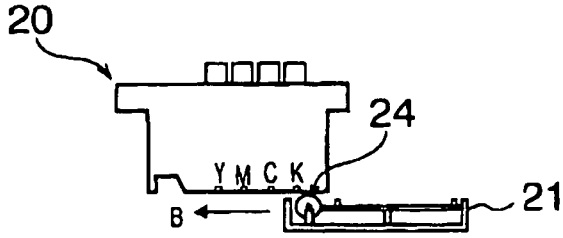

In other words, as shown in FIG. 15F, the head cap 21 is relatively moved with respect to the print head 20 in the direction indicated by the arrow B. Both the head cap 21 and the cleaning roller 24 are moved in the direction indicated by the arrow B with respect to the print head 20 and shifted into a closed position, and the operation returns to the initial state shown in FIG. 15A. In the return route, the cleaning roller 24 does not wipe the ink discharge nozzles 23 off, and ink is not preliminarily discharged, with the aim of increasing the life of the cleaning roller 24 to reduce the number of times the cleaning roller 24 is replaced with a new one.

When printing of the recording paper 51 has completed in this way, as shown in FIG. 9, the recording paper 51 is then conveyed from the portion under the print head 20 in the direction indicated by the arrow M and output from the tray insertion slot 15, which also functions as an output slot, to the paper output receiving unit 14*a* disposed at the top of the recording-paper tray 14. Then, as shown in FIG. 8, the leading end 55 of the belt conveying means 54 is moved downward in the direction indicated by the arrow H, the head cap 21 closes the lower face of the print head 20, the operation returns to the state in which printing is inactive, and the inkjet printer 11 stops operation. This waiting state continues until the inkjet printer 11 starts printing in response to an input control signal.

As described above, since the platen plate 1 shown in FIG. 12 includes the waste ink tube 60 mounted to the bottom 1*b*, the ink preliminarily discharged to the platen plate 1 flows out of the platen plate 1. Therefore, if a large amount of ink is discharged, the ink is prevented from spilling from the platen plate 1, thus avoiding the ribs from being stained with ink.

In the aforementioned description, at a time when an operation of discharging ink begins, the head cap 21 is opened, ink present in the ink discharge nozzles 23 is sucked by moving the cleaning roller 24 while the cleaning roller 24 is in contact with the ink discharge surface 22, and, after the cleaning roller 24 has been moved over the ink discharge surface 22, ink droplets are preliminarily discharged from the ink discharge nozzles 23 to the platen plate 1. However, the present invention is not limited to this structure. The ink discharge nozzles 23 may be cleaned by only preliminarily discharging ink droplets to the platen plate 1 at a time when the operation of discharging ink begins.

In other words, as shown in FIG. 15D, in a state where the head cap 21 is in the withdrawal position, ink may be preliminarily discharged from the ink discharge nozzles 23 to the platen plate 1 without opening and closing the head cap 21, i.e., without cleaning the ink discharge surface 22 with the cleaning roller 24. Therefore, the ink discharge surface 22 can be prevented from being damaged, cleaning effects for the ink discharge nozzles 23 and the adjacent areas can be enhanced, and the time required for a series of performance maintaining operations can be reduced. As a result, preliminarily discharging ink from the ink discharge nozzles 23, wiping the ink discharge surface 22 with the cleaning roller 24, and sucking ink present in the ink discharge nozzles 23 can be performed independently of each other, and furthermore, preheating can be added. Therefore, a suitable maintenance sequence conforming to the status of use of an apparatus, ink features, and environmental conditions can be used.

A case in which preliminary discharge is performed after an operation of discharging ink is now described.

At a time when an operation of discharging ink ends, ink present in the ink discharge nozzles 23 is sucked and removed by contacting an outer face of the cleaning roller 24 to the ink discharge surface 22, and, when the cleaning roller 24 moves the ink discharge surface 22, ink droplets are preliminarily discharged from the ink discharge nozzles 23 to the platen plate 1.

Specifically, at a time when an operation of discharging ink with respect to the recording paper 51 ends, the head cap 21 temporarily closed is reopened and reclosed by rotational driving by the movement motor 44, as shown in FIGS. 15A to 15D, and the cleaning roller 24 is moved while the outer face of the cleaning roller 24 is in contact with the ink discharge surface 22. Ink present in the ink discharge nozzles 23 is sucked and removed by using the elastic deformation of the cleaning roller 24 occurring when the cleaning roller 24 is moved. After the cleaning roller 24 has been moved over the ink discharge surface 22, ink is preliminarily discharged from the ink discharge nozzles 23 to the platen plate 1. Therefore, the ink discharge surface 22 of the print head 20 can be prevented from being damaged, cleaning effects for the ink discharge nozzles 23 and the adjacent areas can be enhanced, and the time required for a series of performance maintaining operations can be reduced.

As described above, since the waste ink tube 60 is mounted to the bottom 1*b* of the platen plate 1 shown in FIG. 12, the ink preliminarily discharged to the platen plate 1 flows out of the platen plate 1. Therefore, if a large amount of ink is discharged, the ink is prevented from spilling from the platen plate 1, thus avoiding the ribs from being stained with ink.

In the aforementioned description, at a time when an operation of discharging ink ends, the head cap 21 temporarily closed is reopened and reclosed, the ink present in the ink discharge nozzles 23 is sucked and removed by moving the cleaning roller 24 while the cleaning roller 24 is in contact with the ink discharge surface 22, and, after the cleaning roller 24 has been moved over the ink discharge surface 22, the ink is preliminarily discharged from the ink discharge nozzles 23 to the platen plate 1. However, the present invention is not limited to this structure. A structure may be applied in which the ink discharge nozzles 23 is cleaned by only preliminarily discharging ink droplets to the platen plate 1 when the head cap 21 is in the withdrawn state, as shown in FIG. 15D, regardless of whether opening and closing the head cap 21 is performed or not, i.e., without performing cleaning of the ink discharge surface 22 with the cleaning roller 24, at a time when an operation of discharging ink to the recording paper 51 ends.

Therefore, the ink discharge surface 22 can be prevented from being damaged, cleaning effects for the ink discharge nozzles 23 and the adjacent areas can be enhanced, and the time required for a series of performance maintaining operations can be reduced. As a result, preliminarily discharging ink from the ink discharge nozzles 23, wiping the ink discharge surface 22 with the cleaning roller 24, and sucking ink present in the ink discharge nozzles 23 can be performed independently of each other, and furthermore, preheating can be added. Therefore, a suitable maintenance sequence conforming to the status of use of an apparatus, ink features, and environmental conditions can be used.

In the aforementioned description, as the head cap 21 is moved in the direction indicated by the arrow A, the cleaning roller 24 cleans the ink discharge surface 22 while the cleaning roller 24 is in contact with the ink discharge surface 22, ink is preliminarily discharged after the cleaning of the ink discharge surface 22, and, as the head cap 21 returns in the direction indicated by the arrow B, the cleaning roller 24 is not in contact with the ink discharge surface 22. However, the present invention is not limited to this structure. A structure may be applied in which at a time when an operation of discharging ink ends, the ink is preliminarily discharged from the ink discharge nozzles 23 to the platen plate 1 before the head cap 21 is closed and the cleaning roller 24 is moved while the outer face of the cleaning roller 24 is in contact with the ink discharge surface 22.

In this case, although not illustrated in the Figures, at a time when an operation of discharging ink ends, before ink present in the ink discharge nozzles 23 is sucked and removed by using elastic deformation of the cleaning roller 24 occurring when the cleaning roller 24 is moved while the outer face of the cleaning roller 24 is in contact with the ink discharge surface 22 as the head cap 21 is closed, ink is preliminarily discharged from the ink discharge nozzles 23 to the platen plate 1. Therefore, the ink discharge surface 22 of the print head 20 can be prevented from being damaged, cleaning effects for the ink discharge nozzles 23 and the adjacent areas can be enhanced, and the time required for a series of performance maintaining operations can be reduced.

A case is described in which, after an operation of discharging ink begins, every time the number of printed pages reaches a predetermined number, preliminarily discharge is performed.

After an operation of discharging ink to the recording paper 51 begins, every time the number of printed pages of the recording paper 51 reaches a predetermined number, the operation of discharging ink is temporarily stopped and then ink present in the ink discharge nozzles 23 is sucked by moving the head cap 21 by control of the drive controlling means and moving the cleaning roller 24 while the outer face of the cleaning roller 24 is in contact with the ink discharge surface 23, and, after the cleaning roller 24 has been moved over the ink discharge surface 22, ink droplets are preliminarily discharged from the ink discharge nozzles 23 to the platen plate 1. Therefore, since the ink droplets are preliminarily discharged from the ink discharge nozzles 23 to the platen plate 1, the ink discharge surface 22 can be prevented from being damaged, cleaning effects for the ink discharge nozzles 23 and the adjacent areas can be enhanced, and the time required for a series of performance maintaining operations can be reduced.

At this time, as shown in FIGS. 15A to 15C, the head cap 21 accommodating the cleaning roller 24 may be opened and closed in such a way that, as the head cap 21 is opened, relative movement between the cleaning roller 24 and the ink discharge surface 22 while the outer face of the cleaning roller 24 is in contact with the ink discharge surface 22 is caused and, when the operation of discharging ink is temporarily stopped, the head cap 21 is temporarily closed and the head cap 21 is then reopened or in such a way that, as the head cap 21 is closed, relative movement between the cleaning roller 24 and the ink discharge surface 22 while the outer face of the cleaning roller 24 is in contact with the ink discharge surface 22 is caused and, when the operation of discharging ink is temporarily stopped, the head cap 21 is temporarily closed and the head cap 21 is then reopened. Therefore, ink present in the ink discharge nozzles 23 can be sucked and removed by using the elastic deformation of the cleaning roller 24 occurring when the head cap 21 is moved. The head cap 21 is closed after the operation of discharging ink ends. As a result, the ink discharge nozzles 23 of the print head 20 are prevented from being dried and clogged.

Specifically, when printing of the predetermined number of pages has completed, a cap closing trigger signal is then input to the printer body 12. As shown in FIG. 15E, the belt conveying means 54 is moved downward in the direction indicated by the arrow H, the movement motor 44 shown in FIG. 5 is rotated in the reverse direction, the head cap 21 is moved from the withdrawal position of the head cap in the direction indicated by the arrow J' along the same route as that used to reach the withdrawal position, and as a result, the head cap 21 returns to the initial position.

In other words, as shown in FIG. 15F, the head cap 21 is relatively moved in the direction indicated by the arrow B with respect to the print head 20. Both the head cap 21 and the cleaning roller 24 are moved in the direction indicated by the arrow B with respect to the print head 20 and shifted into a closed position, and the operation returns to the initial state, as shown in FIG. 15A. In the return route, the cleaning roller 24 does not wipe the ink discharge nozzles 23 off, and ink is not preliminarily discharged, with the aim of increasing the life of the cleaning roller 24 to reduce the number of times the cleaning roller 24 is replaced with a new one.

When all printing of the recording paper 51 has completed in this way, as shown in FIG. 9, the recording paper 51 is then conveyed from the portion under the print head 20 in the direction indicated by the arrow M and output from the tray insertion slot 15, which also functions as an output slot, to the paper output receiving unit 14*a* disposed at the top of the recording-paper tray 14. Then, as shown in FIG. 8, the leading end 55 of the belt conveying means 54 is moved downward in the direction indicated by the arrow H, the head cap 21 closes the lower face of the print head 20, the operation returns to the state in which printing is inactive, and the inkjet printer 11 stops operation. This waiting state continues until the inkjet printer 11 starts printing in response to an input control signal.

As described above, since the waste ink tube 60 is mounted to the bottom 1*b* of the platen plate 1 shown in FIG. 12, the ink preliminarily discharged to the platen plate 1 flows out of the platen plate 1. Therefore, if a large amount of ink is discharged, the ink is prevented from spilling from the platen plate 1, thus avoiding the ribs from being stained with ink.

In the aforementioned description, after an operation of discharging ink to the recording paper 51 begins, every time the number of printed pages of the recording paper 51 reaches a predetermined number, the operation of discharging ink is temporarily stopped and then ink present in the ink discharge nozzles 23 is sucked by moving the cleaning roller 24 while the outer face of the cleaning roller 24 is in contact with the ink discharge surface 23 by moving the head cap 21 under control of the drive controlling means, and, after the cleaning roller 24 has been moved over the ink discharge surface 22, ink droplets are preliminarily discharged from the ink discharge nozzles 23 to the platen plate 1. However, the present invention is not limited to this structure. A structure may be applied in which after an operation of discharging ink begins, every time the number of printed pages of the recording paper 51 reaches a predetermined number, the operation of discharging ink is temporarily stopped and the ink droplets is preliminarily discharged from the ink discharge nozzles 23 to the platen plate 1 when the head cap 21 is in the withdrawn state.

Therefore, the ink discharge surface 22 can be prevented from being damaged, cleaning effects for the ink discharge nozzles 23 and the adjacent areas can be enhanced, and the time required for a series of performance maintaining operations can be reduced. As a result, preliminarily discharging ink from the ink discharge nozzles 23, wiping the ink discharge surface 22 with the cleaning roller 24, and sucking ink present in the ink discharge nozzles 23 can be performed independently of each other, and furthermore, preheating can be added. Therefore, a suitable maintenance sequence conforming to the status of use of an apparatus, ink features, and environmental conditions can be used.

In the aforementioned description, after an operation of discharging ink to the recording paper 51 begins, every time the number of printed pages of the recording paper 51 reaches a predetermined number, the operation of discharging ink is temporarily stopped, and the head cap 21 is then temporarily closed and then reopened in the direction indicated by the arrow A. At a time when the head cap 21 is reopened, the cleaning roller 24 cleans the ink discharge surface 22 while the cleaning roller 24 is in contact with the ink discharge surface 22, ink is preliminarily discharged after the cleaning of the ink discharge surface 22, and the cleaning roller 24 is not in contact with the ink discharge surface 22 as the head cap 21 returns in the direction indicated by the arrow B. However, the present invention is not limited to this structure. A structure may be applied in which every time the number of printed pages of the recording paper 51 reaches a predetermined number, the operation of discharging ink is temporarily stopped, the head cap 21 is temporarily closed, the head cap 21 is reopened after ink present in the ink discharge nozzles 23 is sucked by moving the cleaning roller 24 while the outer face of the cleaning roller 24 is in contact with the ink discharge surface 22, and, in the order in which the cleaning roller 24 has passed over the rows of the ink discharge nozzles 23 corresponding to the individual colors, ink droplets are preliminarily discharged from the ink discharge nozzles 23 to the platen plate 1.

In this case, although not illustrated in the Figures, at a time when an operation of discharging ink ends, before ink present in the ink discharge nozzles 23 is sucked and removed by using elastic deformation of the cleaning roller 24 occurring when the cleaning roller 24 is moved while the outer face of the cleaning roller 24 is in contact with the ink discharge surface 22 as the head cap 21 is closed, ink is preliminarily discharged from the ink discharge nozzles 23 to the platen plate 1. Therefore, the ink discharge surface 22 of the print head 20 can be prevented from being damaged, cleaning effects for the ink discharge nozzles 23 and the adjacent areas can be enhanced, and the time required for a series of performance maintaining operations can be reduced.

Furthermore, A structure may be applied in which every time the number of printed pages of the recording paper 51 reaches a predetermined number, the operation of discharging ink is temporarily stopped, the head cap 21 is temporarily closed, the head cap 21 is then reopened, ink present in the ink discharge nozzles 23 is sucked by moving the cleaning roller 24 while the cleaning roller 24 is in contact with the cleaning roller 24 when the head cap 21 is reopened, and, after the cleaning roller 24 has passed over the ink discharge nozzles 23 corresponding to the individual colors, ink droplets corresponding to a plurality of colors are preliminarily discharged from the corresponding ink discharge nozzles 23 to the platen plate 1 in a simultaneous manner.

In the aforementioned description relating to the operations shown in FIGS. 15A to 15F, after an operation of discharging ink to the recording paper 51 begins, every time the number of printed pages of the recording paper 51 reaches a predetermined number, the operation of discharging ink is temporarily stopped, and the ink discharge nozzles 23 is cleaned by a combination of suction of ink present in the ink discharge nozzles 23 with the cleaning roller 24 and preliminary discharge of ink droplets from the ink discharge nozzles 23 to the platen plate 1, thus completing a series of performance maintaining operations. However, the present invention is not limited to this structure. A structure may be applied in which after an operation of discharging ink begins, every time a predetermined period of time has elapsed, the operation of discharging ink is temporarily stopped, and the series of performance maintaining operations described above is performed. In this case, as in the above case, the ink discharge surface 22 can be prevented from being damaged, cleaning effects for the ink discharge nozzles 23 and the adjacent areas can be enhanced, and the time required for a series of performance maintaining operations can be reduced.

In the aforementioned description, an inkjet printer that includes a line print head to which present invention is applied is described as an example. However, the present invention is not limited to this. The present invention may be applied to any device as long as it discharges liquid in a liquid chamber of a liquid discharge head in the form of a droplet from a liquid discharge nozzle. For example, the present invention may be applied to an image forming device, such as a copier or a facsimile machine that uses an inkjet recording method. In addition, the present invention may be applied to a piezoelectric inkjet printer. Moreover, the present invention may be applied to an inkjet printer that includes a serial print head.

Furthermore, liquid discharged from the liquid discharge nozzles 23 is not limited to ink. Therefore, the present invention may be applied to another liquid discharging apparatus as long as it forms a row of dots or a dot by discharging liquid in a liquid chamber. For example, the present invention may be applied to a liquid discharging apparatus for discharging a solution containing DNA to a pallet in DNA analysis or other examination.

The invention claimed is:

1. A liquid discharging apparatus for discharging droplets from a liquid discharge nozzle to a discharge object to be discharged, the liquid discharging apparatus including a liquid discharge head having a liquid discharge surface provided with the liquid discharge nozzle, the liquid discharging apparatus comprising:

a platen plate for supporting the discharge object, defining a positional relationship between the discharge object and the liquid discharge head, and receiving the droplets discharged from the liquid discharge head; and a cap member for accommodating a cleaning member therein and protecting the liquid discharge surface of the liquid discharge head, wherein, liquid present in the liquid discharge nozzle is sucked by contacting an outer face of the cleaning member to the liquid discharge surface as the cap member moves from a closed position to an open position, (1) droplets are preliminarily discharged from the liquid discharge nozzle to the platen plate and (2) the outer face of the cleaning member does not contact the liquid discharge surface as the cleaning member returns to the closed position.

2. The liquid discharging apparatus according to claim 1, further comprising discharge controlling means for controlling a discharge operation of discharging the droplets from the liquid discharge nozzle in the liquid discharge surface, wherein, at a time when an operation of discharging liquid to the discharge object begins, preliminary discharge is performed to the platen plate.

3. The liquid discharging apparatus according to claim 1, further comprising discharge controlling means for controlling a discharge operation of discharging the droplets from the liquid discharge nozzle in the liquid discharge surface, wherein, at a time when an operation of discharging liquid to the discharge object ends, preliminary discharge is performed to the platen plate.

4. The liquid discharging apparatus according to claim 1, further comprising discharge controlling means for controlling a discharge operation of discharging the droplets from the liquid discharge nozzle in the liquid discharge surface, wherein, after an operation of discharging liquid to the discharge object begins, every time the number of printed pages of the discharge object reaches a predetermined number, (1) the operation of discharging liquid is temporarily stopped and (2) droplets are preliminarily discharged from the liquid discharge nozzle to the platen plate by control of the discharge controlling means.

5. The liquid discharging apparatus according to claim 1, further comprising discharge controlling means for controlling a discharge operation of discharging the droplets from the liquid discharge nozzle in the liquid discharge surface, wherein, after an operation of discharging liquid to the discharge object begins, every time a predetermined period of time elapses, (1) the operation of discharging liquid is temporarily stopped, and (2) droplets are preliminarily discharged from the liquid discharge nozzle to the platen plate by control of the discharge controlling means.

6. A liquid discharging apparatus for discharging droplets from a liquid discharge nozzle to a discharge object to be discharged, the liquid discharging apparatus including a liquid discharge head having a liquid discharge surface provided with the liquid discharge nozzle, the liquid discharging apparatus comprising:

a cleaning member formed of an elastic material and having a cylindrical shape;

moving means for causing relative movement between the cleaning member and the liquid discharge surface while an outer face of the cleaning member is in contact with the liquid discharge surface of the liquid discharge head;

drive controlling means for controlling driving of the moving means;

discharge controlling means for controlling a discharge operation of discharging the droplets from the liquid discharge nozzle in the liquid discharge surface;

a platen plate for supporting the discharge object, defining a positional relationship between the discharge object and the liquid discharge head, and receiving the droplets discharged from the liquid discharge head; and a cap member for accommodating the cleaning member therein and protecting the liquid discharge surface of the liquid discharge head, wherein, liquid present in the liquid discharge nozzle is sucked by performing movement while the outer face of the cleaning member is in contact with the liquid discharge surface by driving of the moving means under control of the drive controlling means, and after the cleaning member has moved from a closed position to an open position and passed over the liquid discharge surface, (1) droplets are preliminarily discharged from the liquid discharge nozzle to the platen plate by control of the discharge controlling means and (2) the outer face of the cleaning member does not contact the liquid discharge surface as the cleaning member returns to the closed position.

7. The liquid discharging apparatus according to claim 6, wherein, at a time when an operation of discharging liquid to the discharge object begins, liquid present in the liquid discharge nozzle is sucked by performing movement while the outer face of the cleaning member is in contact with the liquid discharge surface by driving of the moving means under control of the drive controlling means, and after the cleaning member has passed over the liquid discharge surface, droplets are preliminarily discharged from the liquid discharge nozzle to the platen plate by control of the discharge controlling means.

8. The liquid discharging apparatus according to claim 6, wherein, at a time when an operation of discharging liquid to the discharge object ends, liquid present in the liquid discharge nozzle is sucked by performing movement while the outer face of the cleaning member is in contact with the liquid discharge surface by driving of the moving means under control of the drive controlling means, and when the cleaning member moves the liquid discharge surface, droplets are preliminarily discharged from the liquid discharge nozzle to the platen plate by control of the discharge controlling means.

9. The liquid discharging apparatus according to claim 6, wherein, after an operation of discharging liquid to the discharge object begins, every time the number of printed pages of the discharge object reaches a predetermined number, (1) the operation of discharging liquid is temporarily stopped (2) and droplets are preliminarily discharged from the liquid discharge nozzle to the platen plate by control of the discharge controlling means.

10. The liquid discharging apparatus according to claim 6, further comprising discharge controlling means for controlling a discharge operation of discharging the droplets from the liquid discharge nozzle in the liquid discharge surface, wherein, after an operation of discharging liquid to the discharge object begins, every time a predetermined period of time elapses, (1) the operation of discharging liquid is temporarily stopped and (2) droplets are preliminarily discharged from the liquid discharge nozzle to the platen plate by control of the discharge controlling means.

11. The liquid discharging apparatus according to claim 6, wherein, the cap member is opened and closed by driving of the moving means, relative movement between the cleaning member and the liquid discharge surface while the outer face of the cleaning member is in contact with the liquid discharge surface of the liquid discharge head is caused as the cap member is opened, and after the cleaning member has passed over the liquid discharge surface, droplets are preliminarily discharged from the liquid discharge nozzle to the platen plate by control of the discharge controlling means.

12. The liquid discharging apparatus according to claim 6, wherein, the cap member temporarily closed is reopened and reclosed by driving of the moving means, relative movement between the cleaning member and the liquid discharge surface while the outer face of the cleaning member is in contact with the liquid discharge surface of the liquid discharge head is caused as the cap member is opened, and after the cleaning member has passed over the liquid discharge surface, droplets are preliminarily discharged from the liquid discharge nozzle to the platen plate by control of the discharge controlling means.

13. The liquid discharging apparatus according to claim 1 or claim 6, wherein, the platen plate is formed such that the droplets preliminarily discharged from the liquid discharge nozzle flow out of the platen plate.

14. The liquid discharging apparatus according to claim 6, wherein, the platen plate is formed such that the droplets preliminarily discharged from the liquid discharge nozzle are forced out of the platen plate.

15. A liquid discharging apparatus for discharging droplets from liquid discharge nozzles to a discharge object to be discharged, the liquid discharging apparatus including a liquid discharge head having a liquid discharge surface provided with rows of the liquid discharge nozzles for a plurality of colors, each row of the liquid discharge nozzles corresponding to one color, the liquid discharging apparatus comprising:

a cleaning member formed of an elastic material and having a cylindrical shape;

a cap member for accommodating the cleaning member therein and protecting the liquid discharge surface of the liquid discharge head;

cap opening and closing means for opening and closing the cap member and for, as the cap member is opened, causing relative movement between the cleaning member and the liquid discharge surface in a direction perpendicular to the rows of the liquid discharge nozzles for the colors while an outer face of the cleaning member is in contact with the liquid discharge surface of the liquid discharge head;

drive controlling means for controlling driving of the cap opening and closing means;

discharge controlling means for controlling a discharge operation of discharging the droplets from the liquid discharge nozzles of the liquid discharge surface; and a platen plate for supporting the discharge object, defining a positional relationship between the discharge object and the liquid discharge head, and receiving the droplets discharged from the liquid discharge head, wherein, at a time when an operation of discharging liquid to the discharge object begins, the cap member is opened by driving of the cap opening and closing means under control of the drive controlling means, liquid present in the liquid discharge nozzles is sucked by performing movement (1) while the outer face of the cleaning member is in contact with the liquid discharge surface and (2) as the cap member is opened, and, after the cleaning member has passed over the liquid discharge surface, (1) droplets are preliminarily discharged from the liquid discharge nozzles to the platen plate by control of the discharge controlling means and (2) the cap member is closed without the outer face of the cleaning member contacting the liquid discharge surface.

16. A liquid discharging apparatus for discharging droplets from liquid discharge nozzles to a discharge object to be discharged, the liquid discharging apparatus including a liquid discharge head having a liquid discharge surface provided with rows of the liquid discharge nozzles for a plurality of colors, each row of the liquid discharge nozzles corresponding to one color, the liquid discharging apparatus comprising:

a cleaning member formed of an elastic material and having a cylindrical shape;

a cap member for accommodating the cleaning member therein and protecting the liquid discharge surface of the liquid discharge head;

cap opening and closing means for opening and closing the cap member and for, as the cap member is opened, causing relative movement between the cleaning member and the liquid discharge surface in a direction perpendicular to the rows of the liquid discharge nozzles for the colors while an outer face of the cleaning member is in contact with the liquid discharge surface of the liquid discharge head;

drive controlling means for controlling driving of the cap opening and closing means;

discharge controlling means for controlling a discharge operation of discharging the droplets from the liquid discharge nozzles of the liquid discharge surface; and a platen plate for supporting the discharge object, defining a positional relationship between the discharge object and the liquid discharge head, and receiving the droplets discharged from the liquid discharge head, wherein, at a time when an operation of discharging liquid to the discharge object ends, the cap member temporarily closed is reopened and reclosed by driving of the moving means under control of the drive controlling means, liquid present in the liquid discharge nozzles is sucked by performing movement (1) while the outer face of the cleaning member is in contact with the liquid discharge surface and (2) as the cap member is opened, and, after the cleaning member has passed over the liquid discharge surface, (1) droplets are preliminarily discharged from the liquid discharge nozzles to the platen plate by control of the discharge controlling means and (2) the cap member is closed without the outer face of the cleaning member contacting the liquid discharge surface.

17. A liquid discharging apparatus for discharging droplets from liquid discharge nozzles to a discharge object to be discharged, the liquid discharging apparatus including a liquid discharge head having a liquid discharge surface provided with rows of the liquid discharge nozzles for a plurality of colors, each row of the liquid discharge nozzles corresponding to one color, the liquid discharging apparatus comprising:

a cleaning member formed of an elastic material and having a cylindrical shape;

a cap member for accommodating the cleaning member therein and protecting the liquid discharge surface of the liquid discharge head;

cap opening and closing means for opening and closing the cap member and for, as the cap member is closed, causing relative movement between the cleaning member and the liquid discharge surface in a direction perpendicular to the rows of the liquid discharge nozzles for the colors while an outer face of the cleaning member is in contact with the liquid discharge surface of the liquid discharge head;

drive controlling means for controlling driving of the cap opening and closing means;

discharge controlling means for controlling a discharge operation of discharging the droplets from the liquid discharge nozzles of the liquid discharge surface; and a platen plate for supporting the discharge object, defining a positional relationship between the discharge object and the liquid discharge head, and receiving the droplets discharged from the liquid discharge head, wherein, at a time when an operation of discharging liquid to the discharge object ends, before the cap member is closed by driving of the cap opening and closing means under control of the drive controlling means and movement, (1) droplets are preliminarily discharged from the liquid discharge nozzles to the platen plate and (2) the cap member is closed without the outer face of the cleaning member contacting the liquid discharge surface.

18. The liquid discharging apparatus according to claim 17, wherein, before the cap member is closed by driving of the cap opening and closing means by control of the drive controlling means and movement while the outer face of the cleaning member is in contact with the liquid discharge surface is caused, in the order in which the cleaning member passes over the rows of the liquid discharge nozzles corresponding to the colors, droplets are preliminarily discharged from the liquid discharge nozzles.

19. A liquid discharging apparatus for discharging droplets from liquid discharge nozzles to a discharge object to be discharged, the liquid discharging apparatus including a liquid discharge head having a liquid discharge surface provided with rows of the liquid discharge nozzles for a plurality of colors, each row of the liquid discharge nozzles corresponding to one color, the liquid discharging apparatus comprising:

a cleaning member formed of an elastic material and having a cylindrical shape;

a cap member for accommodating the cleaning member therein and protecting the liquid discharge surface of the liquid discharge head;

cap opening and closing means for opening and closing the cap member and for, as the cap member is opened, causing relative movement between the cleaning member and the liquid discharge surface in a direction perpendicular to the rows of the liquid discharge nozzles for the colors while an outer face of the cleaning member is in contact with the liquid discharge surface of the liquid discharge head;

drive controlling means for controlling driving of the cap opening and closing means;

discharge controlling means for controlling a discharge operation of discharging the droplets from the liquid discharge nozzles of the liquid discharge surface; and a platen plate for supporting the discharge object, defining a positional relationship between the discharge object and the liquid discharge head, and receiving the droplets discharged from the liquid discharge head, wherein, after an operation of discharging liquid to the discharge object begins, every time the number of printed pages of the discharge object reaches a predetermined number, (1) the operation of discharging liquid is temporarily stopped, (2) the cap member is reopened after the cap member is temporarily closed by driving of the cap opening and closing means under control of the drive controlling means, (3) liquid present in the liquid discharge nozzles is sucked by performing movement (i) while the outer face of the cleaning member is in contact with the liquid discharge surface and (ii) as the cap member is reopened, and after the cleaning member has passed over the liquid discharge surface, (4) droplets are preliminarily discharged from the liquid discharge nozzles to the platen plate by control of the discharge controlling means and (5) the cap member is closed without the outer face of the cleaning member contacting the liquid discharge surface.

20. A liquid discharging apparatus for discharging droplets from liquid discharge nozzles to a discharge object to be discharged, the liquid discharging apparatus including a liquid discharge head having a liquid discharge surface provided with rows of the liquid discharge nozzles for a plurality of colors, each row of the liquid discharge nozzles corresponding to one color, the liquid discharging apparatus comprising:

a cleaning member formed of an elastic material and having a cylindrical shape;

a cap member for accommodating the cleaning member therein and protecting the liquid discharge surface of the liquid discharge head;

cap opening and closing means for opening and closing the cap member and for, as the cap member is closed, causing relative movement between the cleaning member and the liquid discharge surface in a direction perpendicular to the rows of the liquid discharge nozzles for the colors while an outer face of the cleaning member is in contact with the liquid discharge surface of the liquid discharge head;

drive controlling means for controlling driving of the cap opening and closing means;

discharge controlling means for controlling a discharge operation of discharging the droplets from the liquid discharge nozzles of the liquid discharge surface; and a platen plate for supporting the discharge object, defining a positional relationship between the discharge object and the liquid discharge head, and receiving the droplets discharged from the liquid discharge head, wherein, after an operation of discharging liquid to the discharge object begins, every time the number of printed pages of the discharge object reaches a predetermined number, (1) the operation of discharging liquid is temporarily stopped, (2) the cap member is temporarily closed by driving of the cap opening and closing means under control of the drive controlling means, (3) the cap member is reopened after liquid present in the liquid discharge nozzles is sucked by performing movement (i) while the outer face of the cleaning member is in contact with the liquid discharge surface and (ii) as the cap member is opened, and after the cleaning member has passed over the liquid discharge surface, (4) droplets are preliminarily discharged from the liquid discharge nozzles to the platen plate by control of the discharge controlling means, and (5) the cap member is closed without the outer face of the cleaning member contacting the liquid discharge surface.

21. A liquid discharging apparatus for discharging droplets from liquid discharge nozzles to a discharge object to be discharged, the liquid discharging apparatus including a liquid discharge head having a liquid discharge surface provided with rows of the liquid discharge nozzles for a plurality of colors, each row of the liquid discharge nozzles corresponding to one color, the liquid discharging apparatus comprising:

a cleaning member formed of an elastic material and having a cylindrical shape;

a cap member for accommodating the cleaning member therein and protecting the liquid discharge surface of the liquid discharge head;

cap opening and closing means for opening and closing the cap member and for, as the cap member is opened, causing relative movement between the cleaning member and the liquid discharge surface in a direction perpendicular to the rows of the liquid discharge nozzles for the colors while an outer face of the cleaning member is in contact with the liquid discharge surface of the liquid discharge head;

drive controlling means for controlling driving of the cap opening and closing means;

discharge controlling means for controlling a discharge operation of discharging the droplets from the liquid discharge nozzles of the liquid discharge surface; and a platen plate for supporting the discharge object, defining a positional relationship between the discharge object and the liquid discharge head, and receiving the droplets discharged from the liquid discharge head, wherein, after an operation of discharging liquid to the discharge object begins, every time a predetermined period of time elapses, (1) the operation of discharging liquid is temporarily stopped, (2) the cap member is reopened after the cap member is temporarily closed by driving of the cap opening and closing means under control of the drive controlling means, (3) liquid present in the liquid discharge nozzles is sucked by performing movement (i) while the outer face of the cleaning member is in contact with the liquid discharge surface and (ii) as the cap member is reopened, and after the cleaning member has passed over the liquid discharge surface as the cap member is opened, (4) droplets are preliminarily discharged from the liquid discharge nozzles to the platen plate by control of the discharge controlling means and (5) the cap member is closed without the outer face of the cleaning member contacting the liquid discharge surface.

22. A liquid discharging apparatus for discharging droplets from liquid discharge nozzles to a discharge object to be discharged, the liquid discharging apparatus including a liquid discharge head having a liquid discharge surface provided with rows of the liquid discharge nozzles for a plurality of colors, each row of the liquid discharge nozzles corresponding to one color, the liquid discharging apparatus comprising:

a cleaning member formed of an elastic material and having a cylindrical shape;

a cap member for accommodating the cleaning member therein and protecting the liquid discharge surface of the liquid discharge head;

cap opening and closing means for opening and closing the cap member and for, as the cap member is closed, causing relative movement between the cleaning member and the liquid discharge surface in a direction perpendicular to the rows of the liquid discharge nozzles for the colors while an outer face of the cleaning member is in contact with the liquid discharge surface of the liquid discharge head;

drive controlling means for controlling driving of the cap opening and closing means;

discharge controlling means for controlling a discharge operation of discharging the droplets from the liquid discharge nozzles of the liquid discharge surface; and a platen plate for supporting the discharge object, defining a positional relationship between the discharge object and the liquid discharge head, and receiving the droplets discharged from the liquid discharge head, wherein, after an operation of discharging liquid to the discharge object begins, every time a predetermined period of time elapses, (1) the operation of discharging liquid is temporarily stopped, (2) the cap member is temporarily closed by driving of the cap opening and closing means under control of the drive controlling means, (3) the cap member is reopened after liquid present in the liquid discharge nozzles is sucked by performing movement (i) while the outer face of the cleaning member is in contact with the liquid discharge surface and (ii) as the cap member is opened, and after the cleaning member has passed over the liquid discharge surface, (4) droplets are preliminarily discharged from the liquid discharge nozzles to the platen plate by control of the discharge controlling means, and (5) the cap member is closed without the outer face of the cleaning member contacting the liquid discharge surface.

23. The liquid discharging apparatus according to any one of claims 15, 16, and 19 to 22, wherein, in the order in which the cleaning member has passed over the rows of the liquid discharge nozzles corresponding to the colors, droplets are preliminarily discharged from the liquid discharge nozzles by control of the discharge controlling means.

24. The liquid discharging apparatus according to any one of claims 15, 16, and 19 to 22, wherein, after the cleaning member has passed over the rows of the liquid discharge nozzles corresponding to the colors, droplets corresponding to the plurality of colors are preliminarily discharged from the liquid discharge nozzles in a simultaneous manner by control of the discharge controlling means.

25. A method for controlling a liquid discharging apparatus for discharging droplets from a liquid discharge nozzle to a discharge object to be discharged, the liquid discharging apparatus including a liquid discharge head having a liquid discharge surface provided with the liquid discharge nozzle, the liquid discharging apparatus being provided with a platen plate for (1) supporting the discharge object, (2) defining a positional relationship between the discharge object and the liquid discharge head, and (3) receiving the droplets discharged from the liquid discharge head, the method comprising:

providing a cap member for accommodating a cleaning member therein and protecting the liquid discharge surface of the liquid discharge head;

sucking liquid present in the liquid discharge nozzle by contacting an outer face of the cleaning member to the liquid discharge surface as the cap member moves from a closed position to an open position;

preliminarily discharging droplets from the liquid discharge nozzle to the platen plate; and returning the cleaning member to the closed position without the outer face of the cleaning member contacting the liquid discharge surface.

26. The method for controlling the liquid discharging apparatus according to claim 25, the method further comprising:

performing preliminary discharge to the platen plate at a time when an operation of discharging liquid to the discharge object begins.

27. The method for controlling the liquid discharging apparatus according to claim 25, the method further comprising:

performing preliminary discharge to the platen plate at a time when an operation of discharging liquid to the discharge object ends.

28. The method for controlling the liquid discharging apparatus according to claim 25, the method further comprising:

temporarily stopping an operation of discharging liquid and preliminarily discharging droplets from the liquid discharge nozzle to the platen plate, every time the number of printed pages of the discharge object reaches a predetermined number, after the operation of discharging liquid to the discharge object begins.

29. The method for controlling the liquid discharging apparatus according to claim 25, the method further comprising:

temporarily stopping an operation of discharging liquid and preliminarily discharging droplets from the liquid discharge nozzle to the platen plate, every time a predetermined period of time elapses, after the operation of discharging liquid to the discharge object begins.

* * * * *